US010463227B2

(12) United States Patent
Beshears, Jr. et al.

(10) Patent No.: US 10,463,227 B2
(45) **Date of Patent: *Nov. 5, 2019**

(54) DISHWASHER RACK SPRAY ASSEMBLY

(71) Applicant: Whirlpool Corporation, Benton Harbor, MI (US)

(72) Inventors: Paul E. Beshears, Jr., Stevensville, MI (US); David H. Chen, Saint Joseph, MI (US); Mark S. Feddema, Kalamazoo, MI (US); Deborah L. Gregory, Saint Joseph, MI (US); Todd M. Jozwiak, Benton Harbor, MI (US); Timothy D. Lee, Kalamazoo, MI (US); Antony M. Rappette, Benton Harbor, MI (US); Jason A. Sibley, Kalamazoo, MI (US); Chad T. VanderRoest, Covert, MI (US); Ameresh B. Viswanathan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/945,138

(22) Filed: Apr. 4, 2018

(65) Prior Publication Data

US 2018/0220870 A1 Aug. 9, 2018

Related U.S. Application Data

(63) Continuation of application No. 14/630,744, filed on Feb. 25, 2015, now Pat. No. 9,962,063.

(Continued)

(51) Int. Cl.

| | |
|---|---|
| ***A47L 15/14*** | (2006.01) |
| ***A47L 15/50*** | (2006.01) |
| ***A47L 15/42*** | (2006.01) |

(52) U.S. Cl.

CPC ..... *A47L 15/508* (2013.01); *A47L 15/4282* (2013.01); *A47L 15/503* (2013.01)

(58) Field of Classification Search

CPC .. A47L 15/23; A47L 15/4221; A47L 15/4282; A47L 15/22; A47L 15/508

(Continued)

(56) References Cited

U.S. PATENT DOCUMENTS 141,620 A * 8/1873 Barton, Jr. ..... B05B 1/1645 239/393

979,771 A * 12/1910 Kunzelmann, Sr. ..... B05B 1/1645 239/393

(Continued)

FOREIGN PATENT DOCUMENTS

DE 7702174 U1 6/1977
DE 2732540 A1 2/1979

(Continued)

OTHER PUBLICATIONS

German Search Report for Counterpart DE102015103128.0, dated Apr. 20, 2016.

*Primary Examiner* — David G Cormier
*Assistant Examiner* — Thomas Bucci
(74) *Attorney, Agent, or Firm* — McGarry Bair PC

(57) ABSTRACT

A dishwasher having a tub defining a treating chamber, a dish rack, and a spray assembly associated with the dish rack. The spray assembly may include at least one sprayer positioned to spray treating liquid onto dishes received by the rack. The sprayer has two openings and may be movable between a first position and a second position.

36 Claims, 29 Drawing Sheets

Related U.S. Application Data

(60) Provisional application No. 61/952,437, filed on Mar. 13, 2014.

(58) Field of Classification Search
USPC ..... 134/172, 176, 198, 179, 56 D, 180, 178, 134/183, 144, 201; 239/251, 261, 264, 239/245, 225.1, 227; 211/41.8, 41.9
See application file for complete search history.

(56) References Cited

U.S. PATENT DOCUMENTS 1,554,521 A * 9/1925 Reece ..... B05B 1/1645 239/394
3,385,525 A * 5/1968 Jacobs ..... B05B 1/1645 239/394
3,637,142 A * 1/1972 Gassaway ..... B05B 1/1645 239/394
4,058,260 A * 11/1977 Lestradet ..... B05B 1/1645 239/394
5,944,037 A * 8/1999 Sinyong ..... A47L 15/23 134/176
5,967,420 A * 10/1999 Kitabayashi ..... B05B 1/1645 239/436
7,182,477 B1 * 2/2007 Hartz ..... F21S 8/00 362/96
7,594,513 B2 9/2009 Vanderroest et al.
7,754,024 B2 * 7/2010 Koch ..... A47L 15/16 134/137
9,962,063 B2 * 5/2018 Beshears, Jr. ..... A47L 15/4282
2002/0190140 A1 * 12/2002 Arenson ..... A62C 31/03 239/391
2003/0192578 A1 * 10/2003 Ochoa, Sr. ..... A47L 15/508 134/176
2012/0138106 A1 6/2012 Fountain et al.
2012/0285491 A1 11/2012 Blanchard et al.
2012/0291827 A1 * 11/2012 Buddharaju ..... A47L 15/4278 134/198
2013/0284827 A1 * 10/2013 Humpal ..... B05B 1/14 239/549
2014/0227431 A1 * 8/2014 Huth ..... B05B 11/3097 427/58

FOREIGN PATENT DOCUMENTS

DE 102004018878 A1 11/2005
EP 0997100 B1 5/2004
EP 1568304 A2 8/2005
EP 2225996 A1 9/2010

* cited by examiner

DISHWASHER RACK SPRAY ASSEMBLY

CROSS REFERENCE TO RELATED APPLICATIONS

This application claims priority to and is a continuation of U.S. patent application Ser. No. 14/630,744, filed Feb. 25, 2015, which is now U.S. Pat. No. 9,962,063, which claims the benefit of U.S. Provisional Patent Application No. 61/952,437, filed Mar. 13, 2014, both of which are incorporated herein by reference in their entirety.

BACKGROUND

Household dishwashers typically include a treating chamber with one or more dish racks for holding various types of dishes. Traditionally, a non-drawer type dishwasher includes an upper rack that holds glassware and small dishes, and a lower rack that holds larger dishes, such as plates. A spray system that provides treating liquid into the treating chamber may include one or more sprayers that direct the liquid onto the dishes in the racks. It can be challenging for the sprayer to provide a sufficient amount of the liquid into glassware with narrow openings, such as bottles and vases.

SUMMARY

An aspect of the present disclosure relates to at least one sprayer, configured to be provided adjacent a rack within a treating chamber of the dishwasher, the at least one sprayer having a first liquid opening and an extension having a second liquid opening wherein the extension is movable between a first position where the treating liquid flows through the first liquid opening into the treating chamber and does not flow through the second liquid opening and a second position, which is raised from the first position, where the treating liquid flows through the second liquid opening into the treating chamber.

Another aspect of the present disclosure relates to a spray assembly for a dishwasher, the spray assembly, comprising a liquid supply conduit and multiple rotatable sprayers rotatably mounted to the liquid supply conduit and rotatable between at least a first position adjacent a bottom of a dish rack located within in a treating chamber of the dishwasher to a second position extending into the dish rack wherein the rotatable sprayers emit spray in both the first and second positions

DETAILED DESCRIPTION

Figure 1:
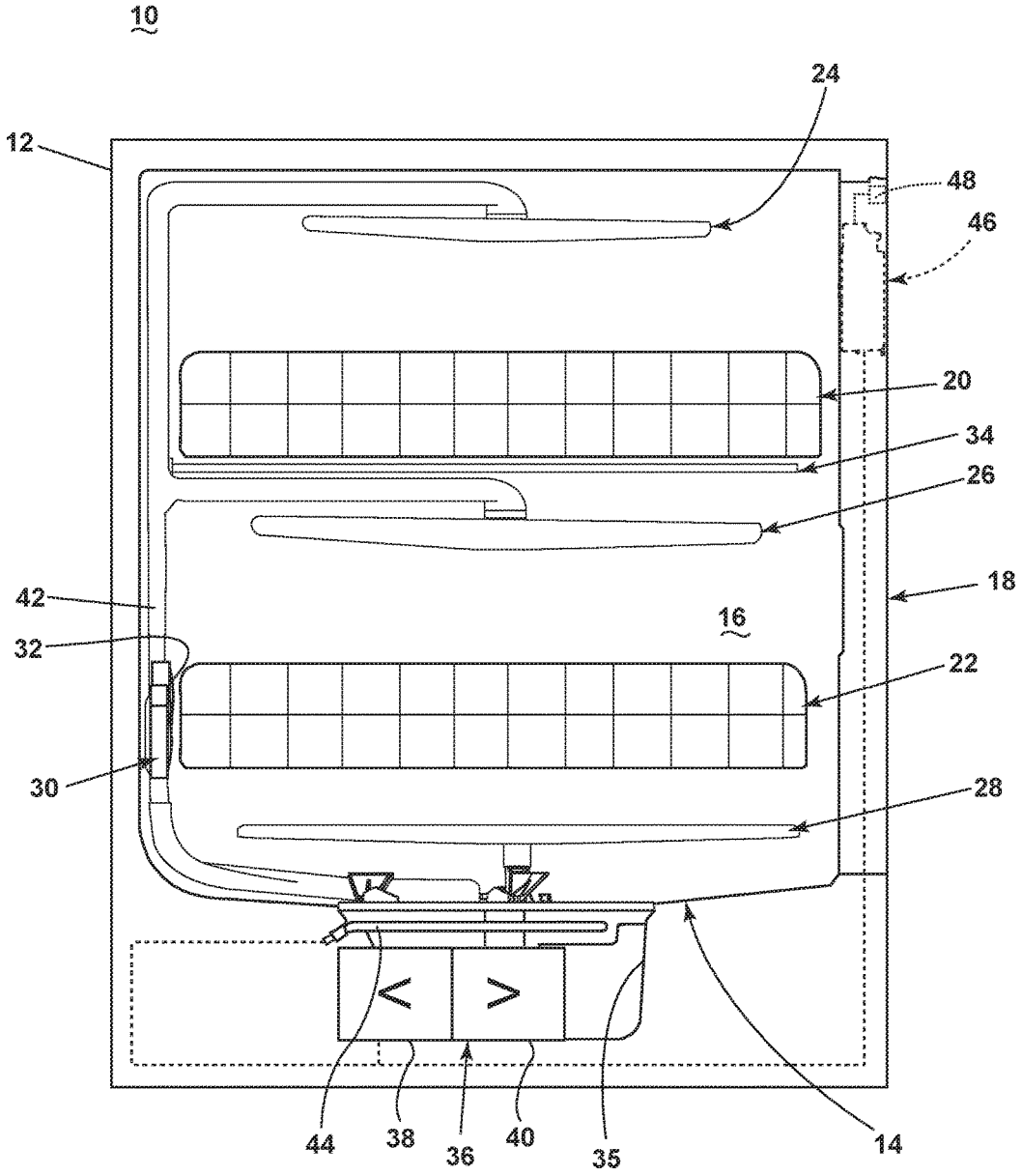
FIG. 1 is a schematic side view of a dishwasher with a rack spray assembly according to one embodiment.

FIG. 1 illustrates a perspective view of an exemplary automated dishwasher 10 according to a first embodiment. The dishwasher 10 shares many features of a conventional automated dishwasher, which will not be described in detail herein except as necessary for a complete understanding of embodiments of the invention. A chassis 12 may define an interior of the dishwasher 10 and may include a frame, with or without panels mounted to the frame. For built-in dishwashers, outer panels are typically not needed. For dishwashers that are not built into existing cabinetry, the chassis 12 may include the panels mounted to the frame to form a cabinet for the dishwasher 10. An open-faced tub 14 may be provided within the chassis 12 and may at least partially define a treating chamber 16 for washing or otherwise treating dishes. The open face of the tub 14 defines an access opening for the treating chamber 16.

A closure element, such as a door assembly 18, may be movably mounted to the dishwasher 10 for movement between opened and closed positions to respectively selectively open and close the treating chamber access opening defined by the open face of the tub 14. Thus, the door assembly 18 provides accessibility to the treating chamber 16 for the loading and unloading of dishes or other washable items. It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open. Alternatively, the closure element may be slidable relative to the chassis 12, such as in a drawer-type dishwasher, wherein the access opening for the treating chamber 16 is formed by an open face of an open-top tub. Other configurations of the closure element relative to the chassis 12 and the tub 14 are also within the scope of embodiments of the invention.

Dish holders, illustrated in the form of upper and lower dish racks 20, 22 may be located within the treating chamber 16 and receive dishes for treatment, such as washing. The upper and lower racks 20, 22 are typically mounted for slidable movement in and out of the treating chamber 16 for ease of loading and unloading. In a drawer-type dishwasher, the dish holders are typically held stationary within the open-top tub and slidably move with the open-tub relative to the chassis 12. Other dish holders may be provided, such as a silverware basket, separate from or combined with the upper and lower racks 20, 22. As used in this description, the term "dish(es)" is intended to be generic to any item, single or plural, that may be treated in the dishwasher 10, including, without limitation, dishes, plates, pots, bowls, pans, glassware, and silverware.

A spray system may be provided for spraying liquid in the treating chamber 16 and may include one or more spray assemblies, such as, for example, an upper spray assembly 24, a middle spray assembly 26, a lower spray assembly 28, and a rear spray assembly 30. The upper spray assembly 24, the middle spray assembly 26, and the lower spray assembly 28 may be located, respectively, above the upper rack 20, between the upper and lower racks 20, 22, and beneath the lower rack 22 and are illustrated as rotating spray arms by example but are not limited to such positions and sprayer type. The rear spray assembly 30 is illustrated as being located adjacent the lower rack 22 toward the rear of the treating chamber 16 and, by example, as including a vertically oriented distribution header or spray manifold 32. An exemplary spray manifold is set forth in detail in U.S. Pat. No. 7,594,513, issued Sep. 29, 2009, and titled "Multiple Wash Zone Dishwasher," which is incorporated herein by reference in its entirety. The spray system may further include a rack spray assembly 34 coupled to the upper dish rack 20; the rack spray assembly 34 will be discussed in further detail below.

A recirculation system may be provided for recirculating liquid from the treating chamber 16 to the spray system. The recirculation system may include a sump 35 and a pump assembly 36. The sump 35 collects the liquid sprayed in the treating chamber 16 and may be formed by a sloped or recess portion of a bottom wall of the tub 14. The pump assembly 36 may include both a drain pump 38 and a recirculation pump 40. The drain pump 38 may draw liquid from the sump 35 and pump the liquid out of the dishwasher 10 to a household drain line (not shown). The recirculation pump 40 may draw liquid from the sump 35, and the liquid may be simultaneously or selectively pumped through a supply tube 42 to each of the spray assemblies 24, 26, 28, 30, 34 for selective spraying. While not shown, a liquid supply system may include a water supply conduit coupled with a household water supply for supplying water to the treating chamber 16.

A heating system including a heater 44 may be located, for example, within the sump 35 for heating the liquid contained in the sump 35.

A control system including a controller 46 may also be included in the dishwasher 10, which may be operably coupled with various components of the dishwasher 10 to implement a treating cycle of operation. The controller 46 may be located within the door assembly 18 as illustrated, or it may alternatively be located somewhere within the chassis 12. The controller 46 may also be operably coupled with a control panel or user interface 48 for receiving user-selected inputs and communicating information to the user. The user interface 48 may include operational controls such as dials, lights, switches, and displays enabling a user to input commands, such as a cycle of operation, to the controller 46 and receive information.

Figure 2:
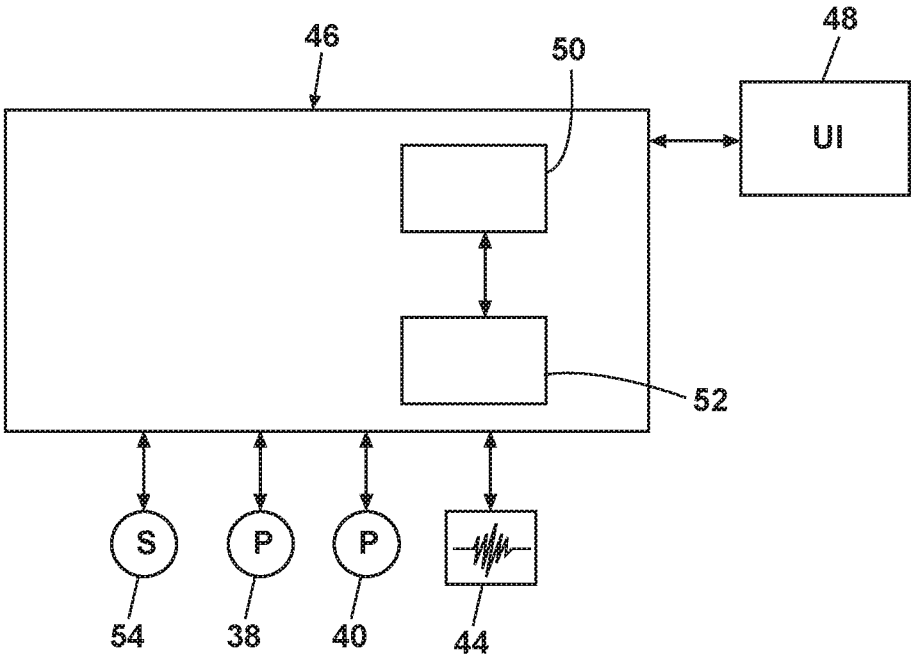
FIG. 2 is a schematic diagram of a control system for the dishwasher of FIG. 1.

As illustrated schematically in FIG. 2, the controller 46 may be coupled with the heater 44 for heating the wash liquid during a cycle of operation, the drain pump 38 for draining liquid from the treating chamber 16, and the recirculation pump 40 for recirculating the wash liquid during the cycle of operation. The controller 46 may be provided with a memory 50 and a central processing unit (CPU) 52. The memory 50 may be used for storing control software that may be executed by the CPU 52 in completing a cycle of operation using the dishwasher 10 and any additional software. For example, the memory 50 may store one or more pre-programmed cycles of operation that may be selected by a user and completed by the dishwasher 10. The controller 46 may also receive input from one or more sensors 54. Non-limiting examples of sensors that may be communicably coupled with the controller 46 include a temperature sensor and turbidity sensor to determine the soil load associated with a selected grouping of dishes, such as the dishes associated with a particular area of the treating chamber 16.

The dishwasher 10 may include all of the above exemplary systems, a selection of the above exemplary systems, and/or other systems not listed above as desired. Further, some of the systems may be combined with other systems and/or may share components with other systems. Examples of other systems that the dishwasher may further include are a dispensing system that supplies one or more treating agents or chemistries to the treating chamber 16 and an air supply system that may provide air, which may be heated or not heated, to the treating chamber 16, such as for drying and/or cooling the dishes. An exemplary air supply system is set forth in U.S. patent application Ser. No. 12/959,673, filed Dec. 3, 2010 and published as U.S. Patent Application Publication No. 2012/0138106 on Jun. 7, 2012, both of which are incorporated herein by reference in their entireties.

Figure 3:
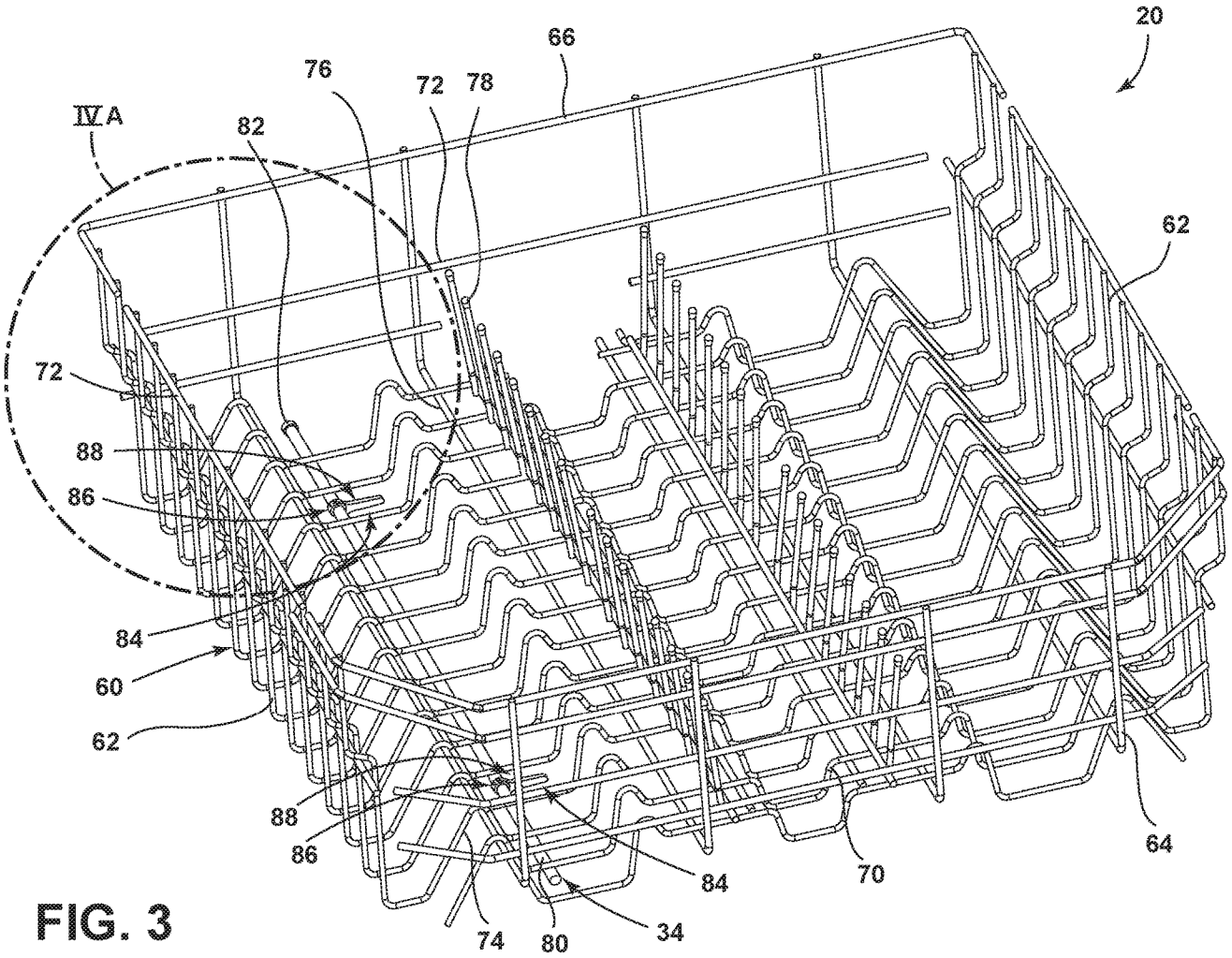
FIG. 3 is a perspective view of a dish rack of the dishwasher of FIG. 1 with the rack spray assembly according to one embodiment with sprayers in a lowered position.

Referring now to FIG. 3, the exemplary upper rack 20 may be formed by a wire frame rack having a peripheral wall 60 formed by a pair of opposed side walls 62 joined by a front wall 64 and a rear wall 66 and a bottom wall 70 joining the lower ends of the peripheral wall 60. The peripheral wall 60 and the bottom wall 70 may be constructed by a plurality of wire elements. Peripheral wire elements 72 may extend generally horizontally around at least a portion of the periphery of the wire frame rack, and side-to-side (extending generally in the direction defined between the side walls 62) and front-to-rear (extending generally in the direction between the front and rear walls 64, 66) intersecting wire elements 74, 76 may intersect one another to form the bottom wall 70. Additionally, the intersecting wire elements 74, 76 may turn upward at their ends in a generally vertical direction to, together with the peripheral wire elements 72, form the peripheral wall 60. Optionally, tines 78 may be integrated with or mounted to the wire frame rack. While illustrated as a wire frame, any of the racks 20, 22 may have a non-wire frame construction. The rack may be of any structure that can support the dishes while permitting for the sprayed liquid to flow back to the sump 35 for recirculation or draining.

The rack spray assembly 34 may be provided on the upper rack 20 in any suitable position. In the present embodiment, the rack spray assembly 34 includes a supply conduit 80 carried by the upper rack 20, such as by clips, brackets, and/or other suitable hardware secured to the bottom wall 70, such that the supply conduit 80 extends below the upper rack 20 in a direction generally parallel to the side walls 62 from near the rear wall 66 towards front wall 64. The supply conduit 80 may have any suitable length and may, for example, have a length corresponding to the depth of the upper rack 20. Further, the supply conduit 80 may have any appropriate configuration and is not limited to the generally linear tubular structure illustrated in FIG. 3. A liquid connector 82 at a rear end of the supply conduit 80 may dock with a corresponding receiver on the supply tube 42 (FIG. 1) or other structure of the liquid supply and/or recirculation systems when the upper rack 20 is slid to its most rearward position in the tub 14 to establish fluid communication with the rack spray assembly 34.

Figure 4B:
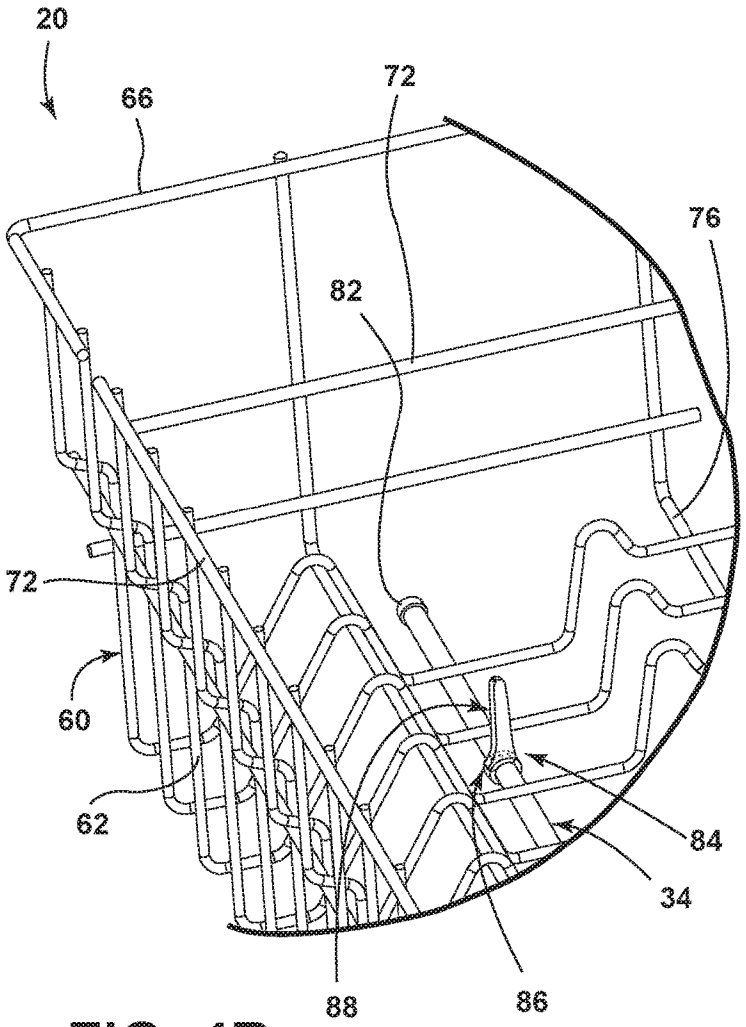
FIG. 4B is a perspective view similar to FIG. 4A with the sprayers in a raised position.
Figure 4A:
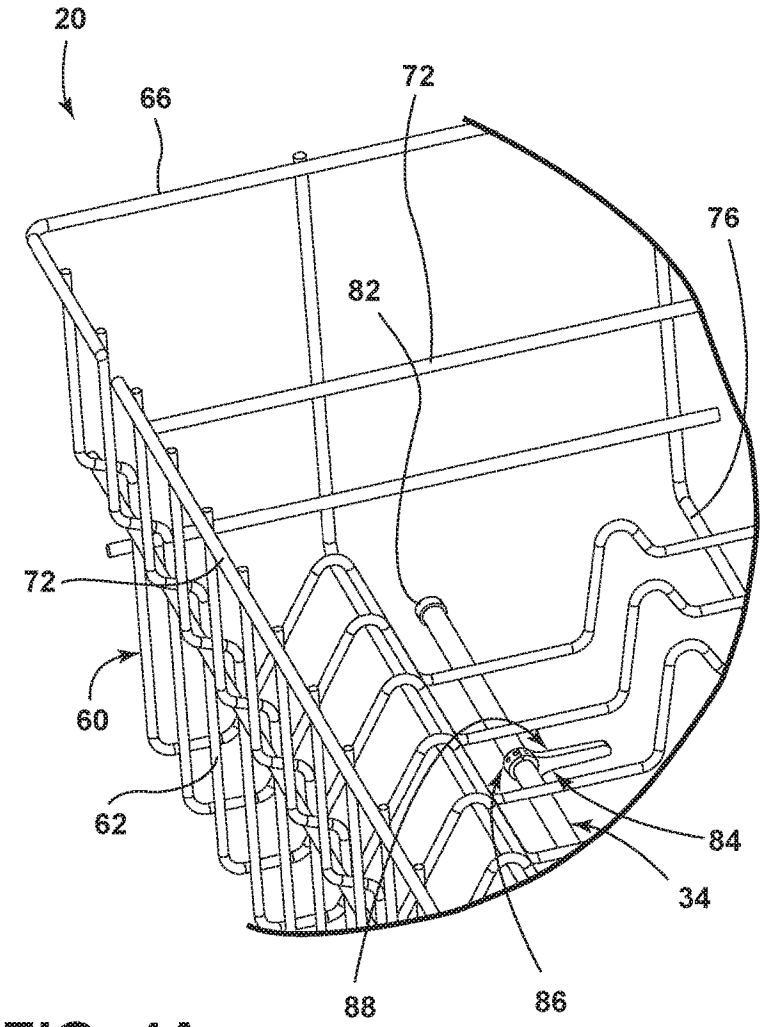
FIG. 4A is an enlarged perspective view of the region labeled IV-A in FIG. 3 to better illustrate the sprayers in the lowered position.

One or more sprayers 84 may be associated with the supply conduit 80 of the rack spray assembly 34, and the illustrated embodiment includes two of the sprayers 84 by example, wherein one sprayer is positioned near each end of the supply conduit 80. The sprayer 84 may include a base 86 and an extension 88 mounted to the base 86. In FIG. 4A, which is an enlarged perspective view of the rear left corner of the dish rack 20, the extension 88 is shown in a lowered position adjacent to the rack bottom wall 70 and pointing away from the interior of the upper rack 20. When the extension 88 is in the lowered position, the extension 88 may be generally horizontal and below the bottom wall 70 of the rack 20 or in some other suitable position not pointing into the upper rack 20. As best seen in FIG. 4B, the extension 88 may be movable relative to the base 86, such as by rotating relative to the base 86, between the lowered position and a raised position, wherein the extension 88 projects upward into the upper rack 20. The extension 88 may be generally vertical when in the raised position or inclined at an acute angle relative to horizontal or relative to the rack bottom wall 70 as long as the extension projects into the upper rack 20.

Figure 5:
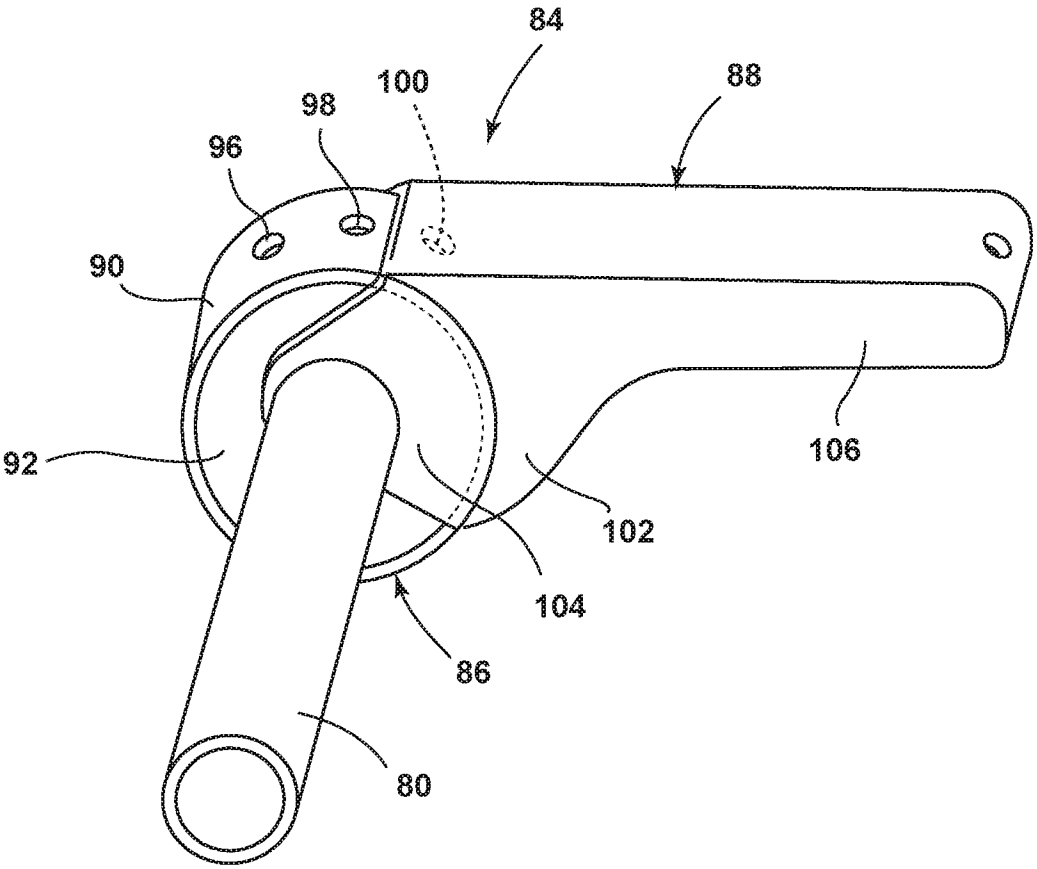
FIG. 5 is an enlarged view of the sprayer from FIG. 3.
Figure 6A:
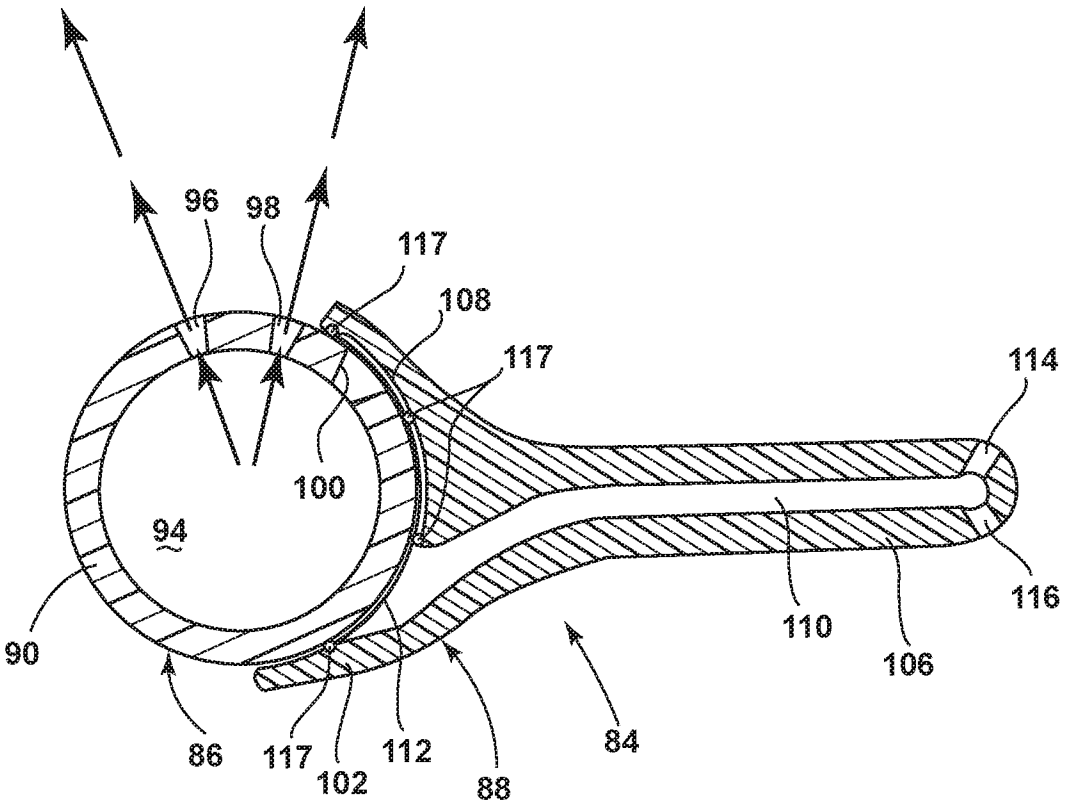
FIGS. 6A and 6B are sectional views of the sprayer from FIG. 3 in the lowered and raised positions, respectively.
Figure 6B:
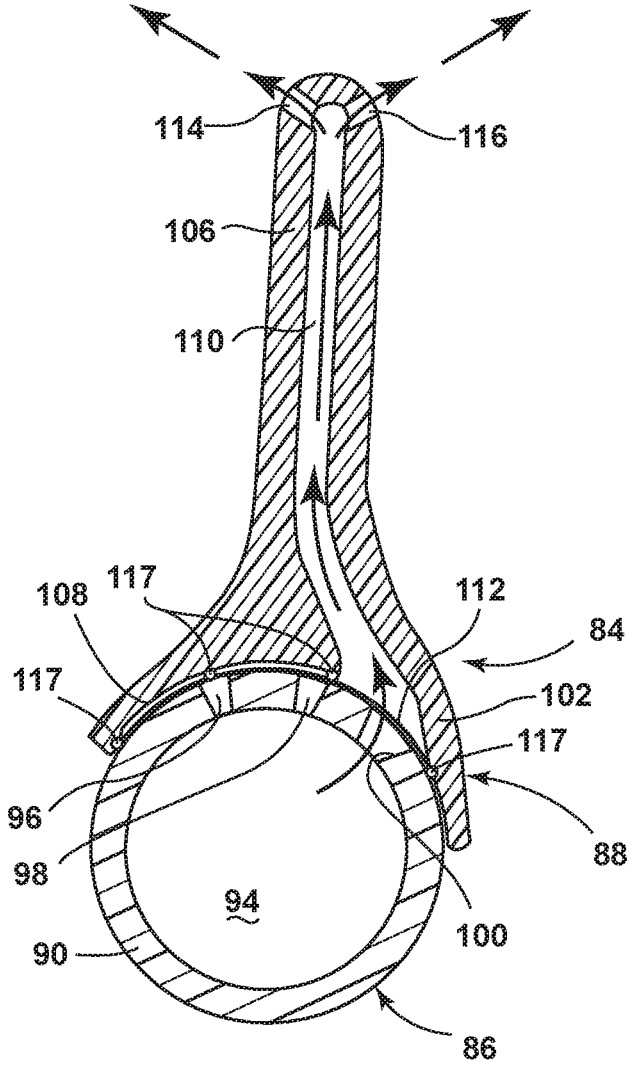

Referring now to FIGS. 5 and 6A-6B, which are enlarged and sectional views, respectively, of the sprayer 84 with the extension 88 in the lowered position (FIGS. 5 and 6A) and the raised position (FIG. 6B), the base 86 of the sprayer 84 may have a generally cylindrical configuration with a sidewall 90 and a pair of opposing end walls 92 defining a hollow interior 94 that liquidly communicates with the supply conduit 80. One or more liquid openings may be formed in the sidewall 90, and the illustrated embodiment includes first, second, and third liquid openings 96, 98, 100 formed in the sidewall 90 and fluidly communicating the hollow interior 94 with areas external to the base 86. The base 86 may be integrally formed with the supply conduit 80 or formed separately from and mounted to the supply conduit 80 in a liquid tight manner.

The extension 88 may include a body 102 from which extends a pair of spaced arms 104 in one direction and an elongated tubular portion 106 in an opposite direction. The arms 104, one of which is viewable in FIG. 5, may straddle the base 86 along the end walls 92 of the base 86 for coupling with the supply conduit 80. The arms 104 may each have a generally triangular configuration and may encircle the supply conduit 80 at the apex to facilitate rotation of the extension 88 about the supply conduit 80 relative to the base 86. The body 102 may conform to the shape of the base 86 and transition the extension 88 from the arms 104 to the tubular portion 106, which may have a handle configuration to facilitate manual movement of the extension 88 by a user. As best seen in FIG. 6A, internally, the body 102 of the extension 88 forms a blocking portion 108 on one side and a liquid channel 110 on another side. While the blocking portion 108 may have any suitable configuration, the blocking portion 108 of the illustrated embodiment may be sized to at least cover the first and second liquid openings 96, 98 on the base 86. The liquid channel 110 may extend from an inlet 112 at the body 102 and along the length of the tubular portion 106 to outlets in the form of fourth and fifth liquid openings 114, 116 located at the end of the tubular portion 106. The inlet 112 may have any suitable configuration and may be sized in accordance with the third liquid opening 100 in the base 86.

Figure 7A:
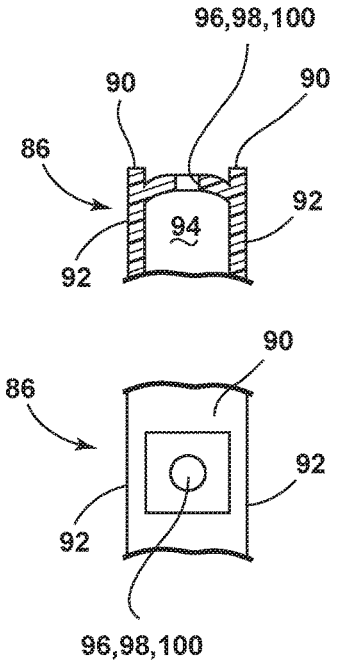
FIGS. 7A-7C are sectional and top views of exemplary recessed liquid openings for use in the sprayer of FIG. 3.
Figure 7B:
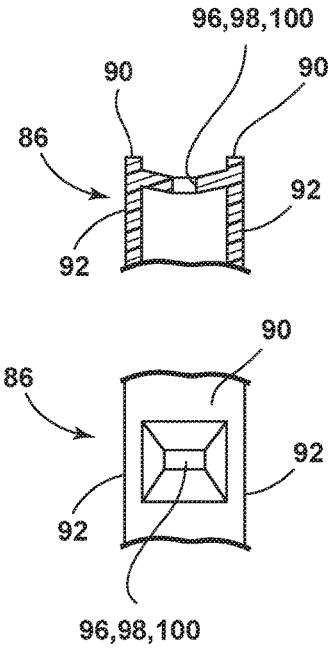
Figure 7C:
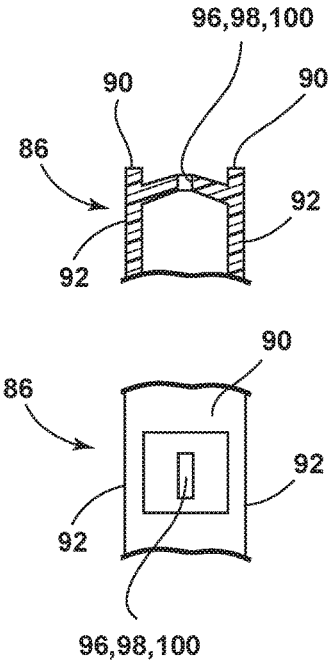

A sealing system may be positioned between the base 86 and the extension 88 to prevent undesired liquid leakage. For example, o-rings, gaskets, and/or other sealing elements 117 may be arranged on the extension 88 to surround the first, second, and third liquid openings 96, 98, 100 depending on the position of the extension 88, as seen in FIGS. 6A and 6B. Optionally, the first, second, and third liquid openings 96, 98, 100 may be recessed within the sidewall 90 of the base 86 so that the sealing elements 117 are not damaged by features of the first, second, and third liquid openings 96, 98, 100 as the sealing elements 117 travel across the first, second, and third liquid openings 96, 98, 100 when the extension 88 moves relative to the base 86. Exemplary configurations of the recessed first, second, and third liquid openings 96, 98, 100 are illustrated in FIGS. 7A, 7B, and 7C. The sidewall 90 forms the sealing surface upon which the sealing elements 117 rest.

Referring back to FIGS. 6A and 6B, the first and second liquid openings 96, 98 on the base 86 and the fourth and fifth liquid openings 114, 116 on the extension 88 may be defined by spray nozzles that are configured to dispense the liquid into a spray having a desired pattern, capacity, impact, angle, and drop size. The spray nozzles defining the first and second liquid openings 96, 98 may be the same or different than the spray nozzles defining the fourth and fifth liquid openings 114, 116, depending on whether the desired sprays from the liquid openings 96, 98, 114, 116 are the same or different, as will be more apparent in the description below of the operation of the sprayer 84.

An exemplary operation of the sprayers 84 of the rack spray assembly 34 will now be described with the extensions 88 assumed to be initially in the lowered position of FIGS. 3, 4A, 5, and 6A. A user may slide the upper rack 20 forward from the tub 14 and, if desired, manually raise the extension 88 for a desired sprayer 84 upon which the user wishes to place a bottle, jar, or other relatively tall dish. The user may grasp the extension 88 at the elongated tubular portion 106 and rotate the extension 88 about the longitudinal axis of the base 86 to the raised position projecting into the dish rack 20, as shown in FIGS. 4B and 6B. With the extension 88 raised, the user may then place the dish on the extension 88 within the dish rack 20. This process can be repeated for as many of the sprayers 84 as desired. If the user does not wish to use one of the sprayers 84 for a relatively tall dish, the sprayer 84 may remain in the lowered position. If a sprayer 84 happens to be in the raised position but is not intended for use with a relatively tall dish, the user may grasp the extension 88 and rotate it about the longitudinal axis of the base 86 to the lowered position so that it does not interfere with loading of the dishes. With all dishes loaded into the upper rack 20, the user may then slide the upper rack 20 rearward into the tub 14 for fluidly coupling the liquid connector 82 with the corresponding receiver on the supply tube 42 (FIG. 1).

The conversion of the sprayer 84 resulting from movement of the extension 88 will now be described in further detail with reference to FIGS. 6A and 6B. As shown in FIG. 6A, before the user raises the extension 88, the elongated tubular portion 106 of the extension 88 is in a generally horizontal orientation with the body blocking portion 108 covering the third liquid opening 100. The first and second liquid openings 96, 98 are not covered or otherwise blocked by the extension 88. When the extension 88 moves to the raised position of FIG. 6B, the blocking portion 108 covers the first and second liquid openings 96, 98, and the inlet 112 aligns with the third liquid opening 100 to establish fluid communication between the third liquid opening 100 and the liquid channel 110 and, thereby, the fourth and fifth liquid openings 114, 116.

With the dish rack 20 slid to the most rearward position in the tub 14, the user may initiate a treating cycle of operation during which liquid may be supplied to the rack spray assembly 34. The liquid may flow through the supply conduit 80 to each of the sprayers 84. For the sprayers 84 with the extension 88 in the lowered position of FIG. 6A, the liquid will flow through the first and second liquid openings 96, 98 and spray into the treating chamber 16, particularly upwardly into the dish rack 20 for treating the dishes held therein. Liquid flow from the third liquid opening 100 will be blocked by the extension 88. However, for the sprayers 84 with the extension 88 in the raised position of FIG. 6B, liquid will flow through the third liquid opening 100, into the liquid channel 110 from the inlet 112, and into the treating chamber 16 through the fourth and fifth liquid openings 114, 116. Liquid flow from the first and second liquid openings 96, 98 will be blocked by the extension 88. Because the extension 88 in the raised position effectively extends or increases the height of the sprayer 84, the liquid exits the sprayer 84 at a position vertically higher than when in the lowered position. The higher spraying of the liquid allows the liquid to more effectively reach the interior of a relatively tall dish that may otherwise be difficult to clean. When the higher dispensing of the liquid is not needed, the sprayer 84 remains active to assist in cleaning other dishes held within the dish rack 20 by spraying liquid from a position closer to the bottom of the dish rack 20.

The number, size, and configuration of the liquid openings of the sprayer 84 may be modified as needed in both the base 86 and the extension 88. For example, in the embodiment of FIGS. 6A and 6B, the first and second liquid openings 96, 98 may each have a diameter of about 2 mm (0.08 inches), while the third liquid opening 100 may have a diameter of about 4 mm (0.16 inches). The opening(s) in the base 86 that are employed to provide liquid to the extension 88 may be relatively large compared to the other opening(s) because the liquid flow must be sufficient to reach the end of the extension 88 and spray into the dishes placed on the extension 88. The number, size, and configuration of the openings may be adjusted to provide a desired liquid supply when the extension 88 is in both the raised and lowered positions.

Figure 8B:
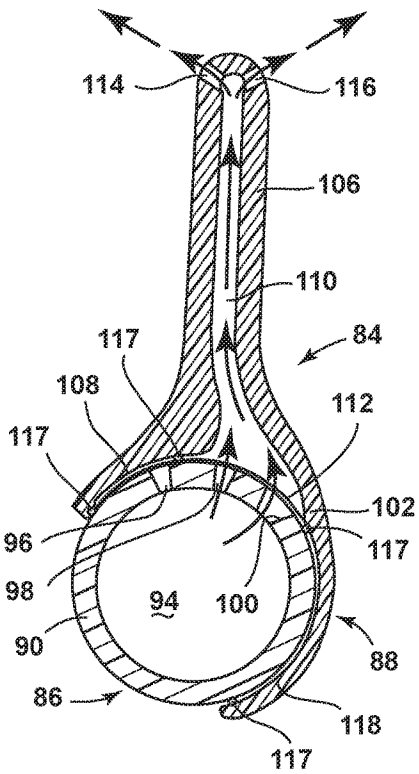
FIGS. 8A-8C are schematic sectional views of an alternative sprayer according to another embodiment in lowered, raised, and closed positions, respectively.
Figure 8A:
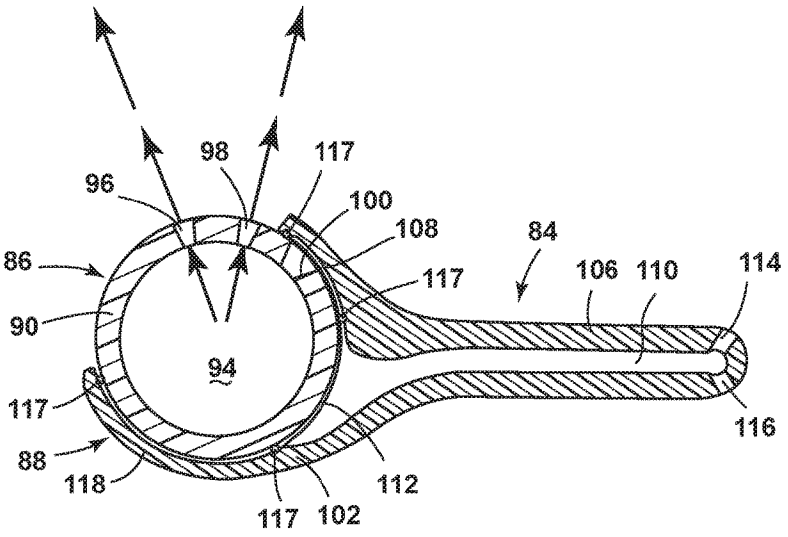
Figure 8C:
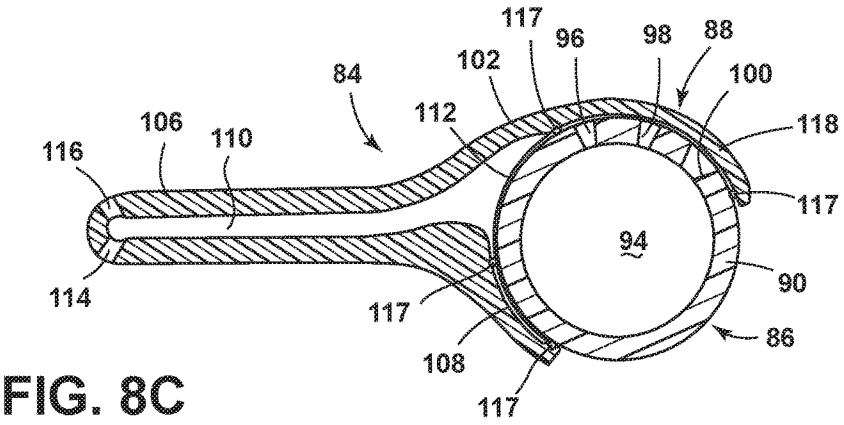

In an alternative embodiment shown in FIGS. 8A-8C, the extension 88 may be configured so that one of the base liquid openings is employed when the extension 88 is in both the raised and lowered positions to increase liquid flow to the extension 88 in the raised position. As seen in FIG. 8A, liquid may flow through the first and second liquid openings 96, 98 in the same manner as described for the previous embodiment when the extension 88 is in the lowered position. However, the extension 88 is configured so that the blocking portion 108 only covers the first liquid opening 96 and not the second liquid opening 98 when the extension 88 is in the raised position of FIG. 8B. The inlet 112 is larger and aligns with both the second and third liquid openings 98, 100 to fluidly communicate both with the liquid channel 110. Thus, the liquid flows through both the second and third liquid openings 98, 100 into the liquid channel 110 for spraying into the treating chamber 16 through the fourth and fifth liquid openings 114, 116.

The extension 88 of the embodiment of FIGS. 8A-8C further includes a closure element 118 that wraps around the base 86 on a side opposite the blocking portion 108. The closure element 118 is sized to cover and block liquid flow from all of the openings on the base 86, that is, the first, second, and third liquid openings 96, 98, 100 of the present embodiment, thus effectively closing the sprayer 84 so no liquid flows from the sprayer 84 into in the treating chamber 16. To close the sprayer 84, the user may continue rotation of the extension 88 about the base 86 beyond the second position to a third position, shown in FIG. 8C, with the closure element 118 covering the first, second, and third liquid openings 96, 98, 100. Other embodiments of the sprayer 84, including those to be disclosed below, may be adapted to include the closure element 118.

Figure 9B:
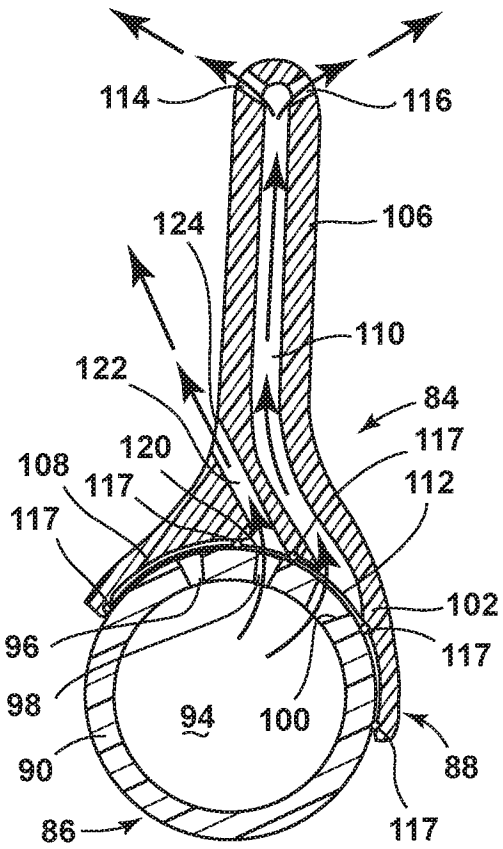
FIGS. 9A and 9B are schematic sectional views of an alternative sprayer according to another embodiment in lowered and raised positions, respectively.
Figure 9A:
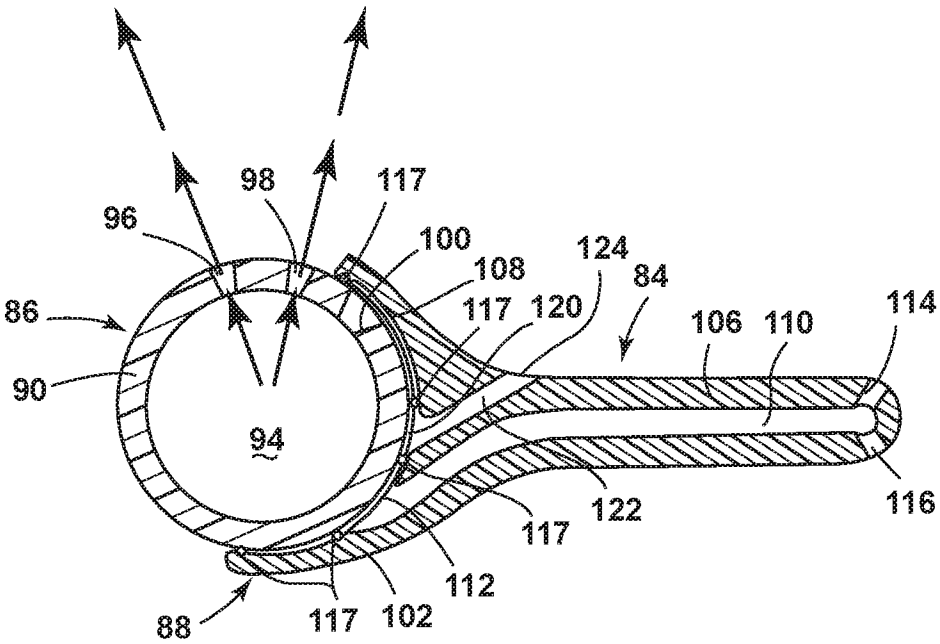

In another alternative configuration shown in FIGS. 9A and 9B, the liquid may flow through the first and second liquid openings 96, 98 when the extension 88 is in the lowered position of FIG. 9A, as in the previous embodiments, but the extension 88 is configured to spray at two different heights when in the raised position. In particular, as shown in FIG. 9B, the blocking portion 108 is sized to cover the first liquid opening 96 when in the raised position, but a second inlet 120 that provides access to a second liquid channel 122 terminating in a sixth liquid outlet 124 is formed in the extension 88 for alignment with the second liquid opening 98. The liquid, therefore, may enter the treating chamber 16 from the fourth and fifth liquid openings 114, 116 via the third liquid opening 100 and from the sixth liquid opening 124 at a height lower than the fourth and fifth liquid openings 114, 116 via the second liquid opening 98. The height of the sixth liquid opening 124 may be at any height lower than the end of the extension 88, including a height directly adjacent the base 86.

Figure 10B:
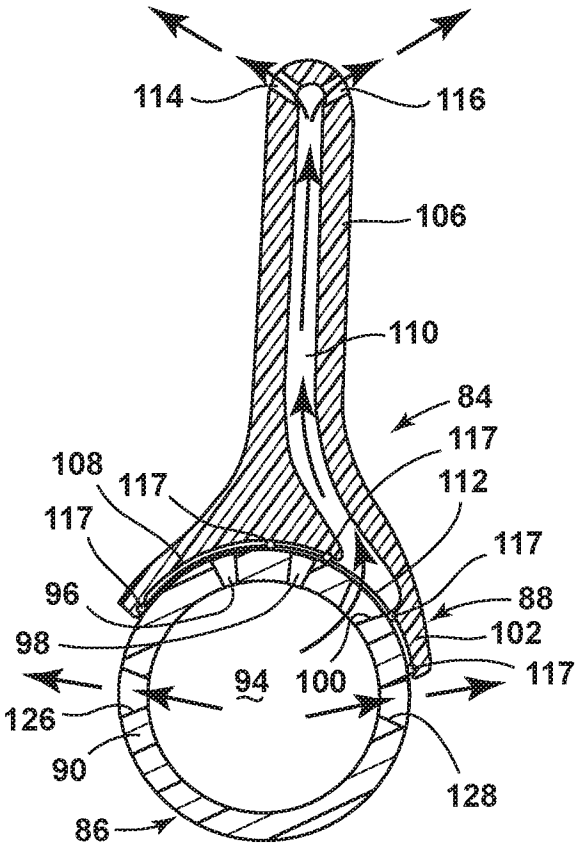
FIGS. 10A and 10B are schematic sectional views of an alternative sprayer according to another embodiment in lowered and raised positions, respectively.
Figure 10A:
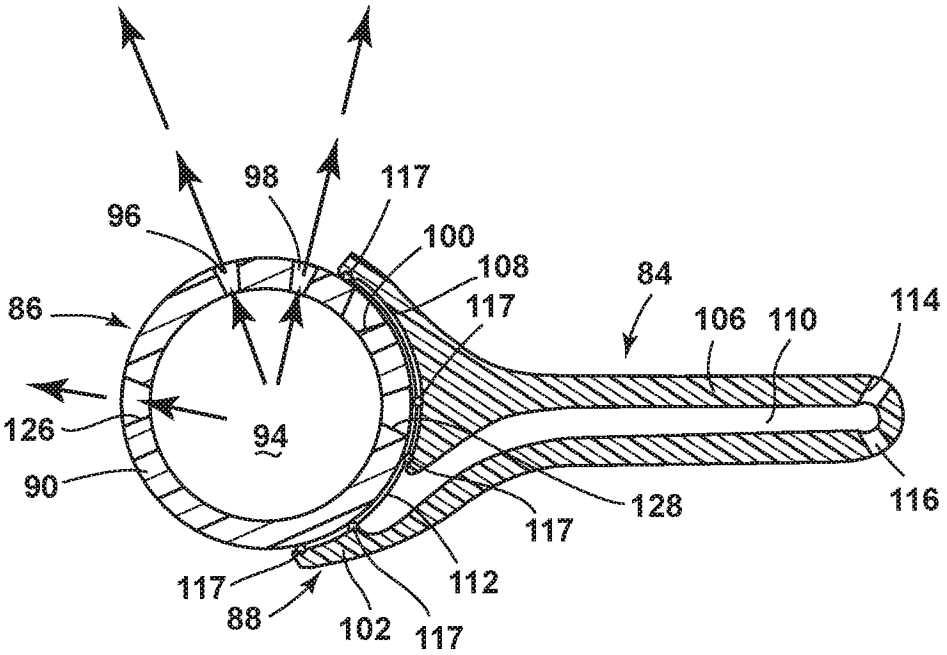

In yet another alternative configuration shown in FIGS. 10A and 10B, the sprayer 84 includes additional liquid outlets that allow the sprayer 206 to spray both into the dish placed on the sprayer 84 and to areas surrounding the dish. To this end, the base 86 may include additional liquid openings, such as seventh and eighth liquid openings 126, 128. When the extension is in the lowered position of FIG. 10A, the blocking portion 108 covers and prevents liquid flow from the eighth liquid outlet 128 while liquid may enter the treating chamber 16 through the first, second, and seventh liquid outlets 96, 98, 126. Referring now to FIG. 10B, movement of the extension 88 to the raised position uncovers the eighth liquid outlet 128 while the seventh liquid outlet 126 remains exposed for liquid flow from both of the openings 126, 128 to areas surrounding a dish that may be placed on the extension 88 in addition to liquid flow at the end of the extension 88 via the third liquid opening 100 into the dish while the first and second liquid openings 96, 98 are covered and blocked by the blocking portion 108.

Various other modifications may be made to the rack spray assembly 34. Any number of the sprayers 84 may be positioned in any suitable location in the dish rack 20, including in the corners of the dish rack. The sprayers 84 may be modified to integrate the base 86 with the supply conduit 80 such that the supply conduit 80 functions as the base 86 with the various liquid openings formed directly in the supply conduit 80. The extension 88 may move in any suitable manner relative to the base 86 and is not limited to rotational movement. The movement of the extension 88 may be manual, as described above, or automatic, whereby the user may select a button or other switch, such as on a user interface, that communicates with the controller 46 and a motorized device to automatically move the extension 88 between the raised and lowered positions. Alternatively, a button or similar switch may be located on the sprayer 84 itself and may be operatively coupled to a motor or a non-motorized actuator or release mechanism for moving the extension 88. Further, when the rack spray assembly 34 includes more than one of the sprayers 84, the movement of the extensions 88 for the sprayers 84 may be independent or linked such that the movement of one of the extensions 88 causes simultaneous or subsequent movement of one or more of the other extensions 88 of other sprayers 84. The operation of the sprayers 84 may be adapted so that the sprayers 84 dispense the treating liquid sequentially rather than all at the same time, thus producing a pulsing effect. Even more, the rack spray assembly 34 may be modified as desired to include other types of sprayers, such as a rotating spray arm, zone sprayers, and the like.

Figure 11:
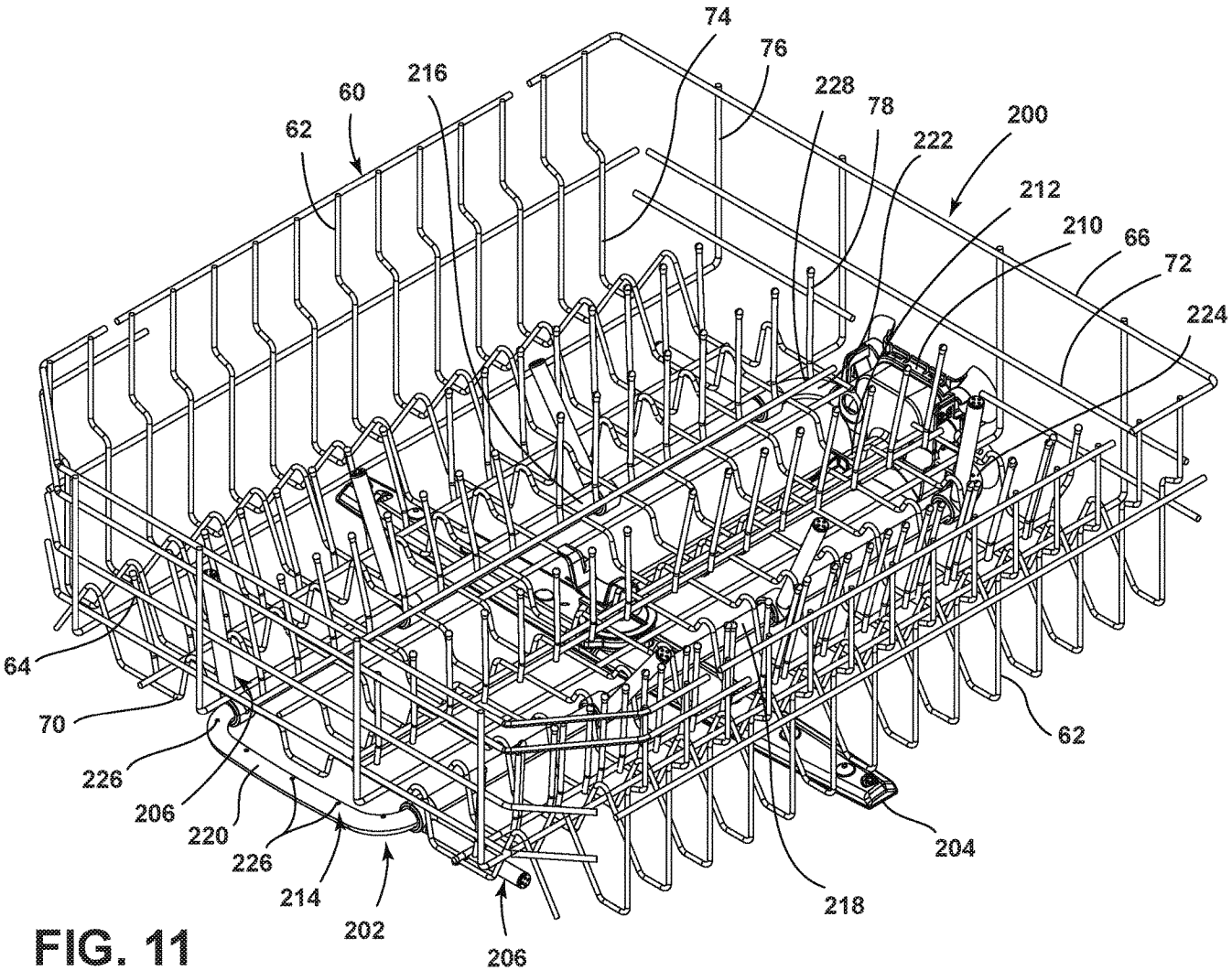
FIG. 11 is a perspective view of an alternative dish rack with an alternative rack spray assembly according to another embodiment.

An alternative embodiment of a dish rack 200 with a rack spray assembly 202 is illustrated in the perspective view of FIG. 11. In this embodiment, the rack spray assembly 202 includes a rotatable spray arm 204 such that the assembly essentially combines the schematic middle spray assembly 26 and rack spray assembly 34 illustrated in FIG. 1. The rack spray assembly 202 of FIG. 11 may be employed with any type of dish rack and is shown by example with the dish rack 200 having the same general elements of the dish rack 20, that is, the peripheral wall 60 formed by the side walls 62, front wall 64, and rear wall 66 and the bottom wall 70. The wire frame for the dish rack 200 may be formed by the similar peripheral wire elements 72, side-to-side wire elements 74, and front-to-back wire elements 76 and may include tines 78. The rack spray assembly 202 may be carried by the dish rack 200, such as by being mounted to the dish rack 200 under the bottom wall 70 of the dish rack 200 by any suitable brackets or other hardware and may include one or more sprayers 206 movable relative to the dish rack 200, as will be described in further detail below.

Figure 12:
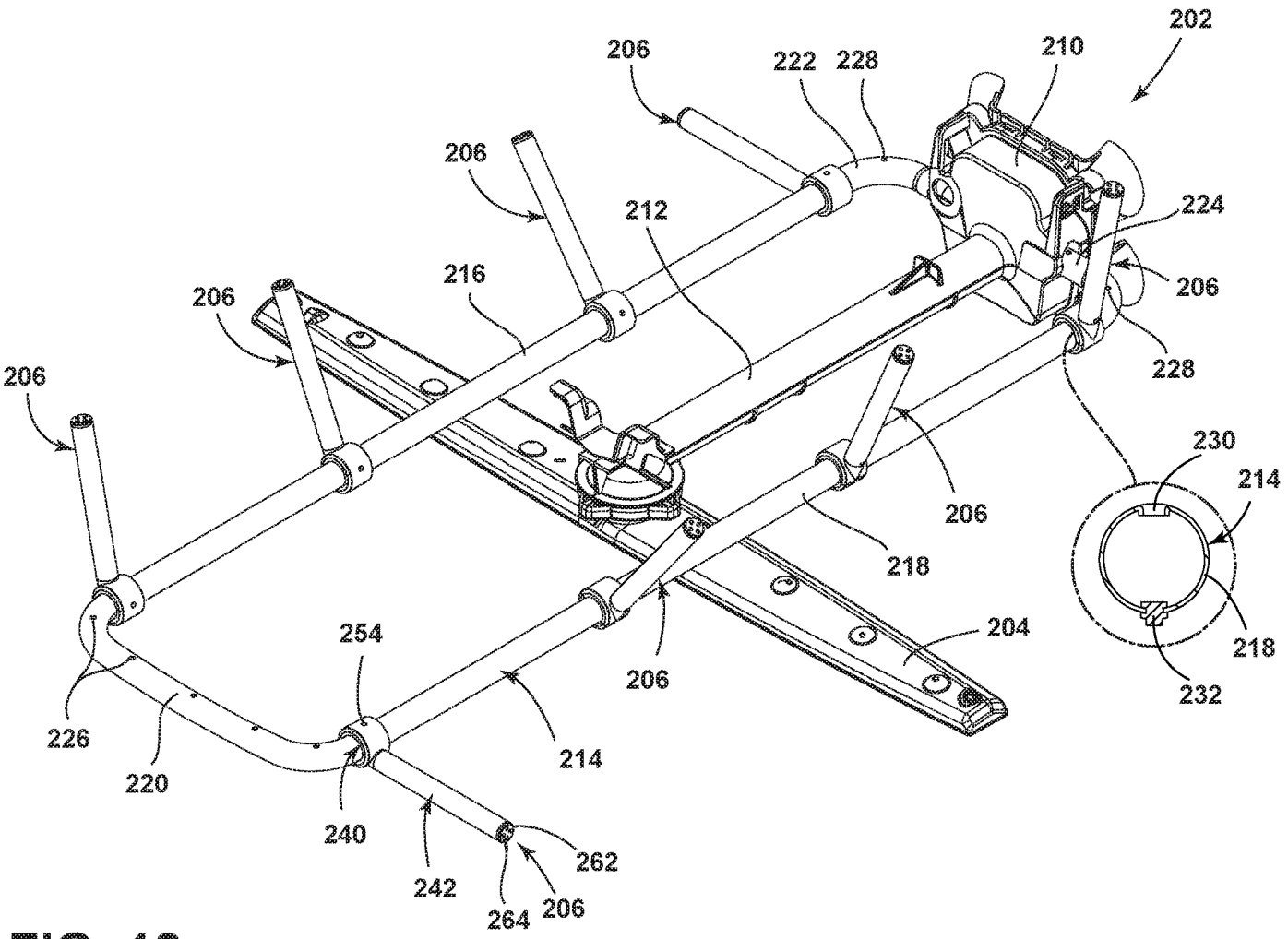
FIG. 12 is a perspective view of the rack spray assembly of FIG. 11.

As better seen in FIG. 12, which is a perspective view of the rack spray assembly 202, the rack spray assembly 202 includes a fluid connector 210 that selectively docks with a corresponding receiver on the supply tube 42 (FIG. 1) or other structure of the liquid supply and/or recirculation systems when the dish rack 200 is slid to its most rearward position in the tub 14 to establish fluid communication with the rack spray assembly 202. The fluid connector 210 may also be configured to supply liquid to a central conduit 212 coupled to the rotatable spray arm 204 positioned approximately at the center of the dish rack 200 (FIG. 12) and to a supply conduit 214 that provides liquid to the sprayers 206. The supply conduit 214 may be disposed above the spray arm 204 to avoid interfering with the rotation of the spray arm 204.

The supply conduit 214 may be formed by a pair of generally parallel, spaced conduits 216, 218 extending approximately from the rear wall 66 to the front wall 64 of the dish rack 200 and joined to each other at their front ends by a front connecting conduit 220, which may be adjacent the front wall 64 of the dish rack 200 (FIG. 11). Together, the spaced conduits 216, 218 and the front connecting conduit 220 form a U-shape for the supply conduit 214, with the spaced conduits 216, 218 as the legs and the front connecting conduit 220 as the bight portion of the U-shape. A pair of rear connecting conduits 222, 224 couple the rear ends of the spaced conduits 216, 218 to the fluid connector 210 for establishing fluid communication between the fluid connector 210 and the supply conduit 214. The spaced conduits 216, 218, the front connecting conduit 220, and the rear connecting conduits 222, 224 may be integrally formed or may comprise individual sections joined together to form the supply conduit 214.

The front connecting conduit 220 may include a plurality of liquid outlets or openings 226 spaced along the length thereof for providing liquid in a generally upward direction into the dish rack 200. A spray nozzle may form each of the liquid openings 226 so as to provide a spray of liquid into the dish rack 200. The liquid openings 226 may have any suitable size, shape, number, and arrangement on the front connecting conduit 220. Additionally or alternatively, the front connecting conduit 220 may include liquid openings (not shown) that direct liquid downward to aid in treating dishes held by a dish rack below the dish rack 200. The openings 226 may also be located along any other portion, not just the connecting conduit 220, of the supply conduit 214, and oriented to spray in any desired direction.

Similarly, the rear connecting conduits 222, 224 may include one or more liquid outlets or openings 228 for providing liquid in a generally upward direction into the dish rack 200. A spray nozzle may form each of the liquid openings 228 so as to provide a spray of liquid into the dish rack 200. The liquid openings 228 may have any suitable size, shape, number, and arrangement on the rear connecting conduits 222, 224. Additionally or alternatively, the rear connecting conduits 222, 224 may include liquid openings (not shown) that direct liquid downward to aid in treating dishes held by a dish rack below the dish rack 200.

The sprayers 206 may be arranged along the spaced conduits 216, 218 in any suitable configuration, and the illustrated embodiment shows four of the sprayers 206 on each of the spaced conduits 216, 218 positioned equidistant from one another by example. As shown in the inset sectional view in FIG. 12, the spaced conduits 216, 218 form a liquid opening 230 in an upper surface thereof at each sprayer position such that the sprayer 206 is mounted to the conduit 216, 218 over the liquid opening 230. A guide pin 232 projects radially downward from the conduit 216, 218 directly below each of the liquid openings 230 on a lower surface of the conduit 216, 218. The guide pin 232 aids in guiding movement of the sprayer 206 and fixing the sprayer 206 in a desired position, as will be described in further detail below.

Figure 13B:
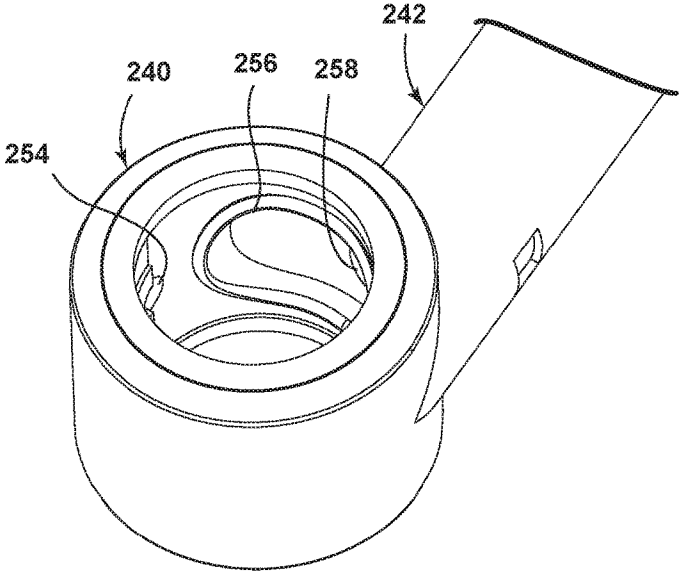
FIG. 13B is an enlarged view of the region identified as XIII-B in FIG. 13A.
Figure 13A:
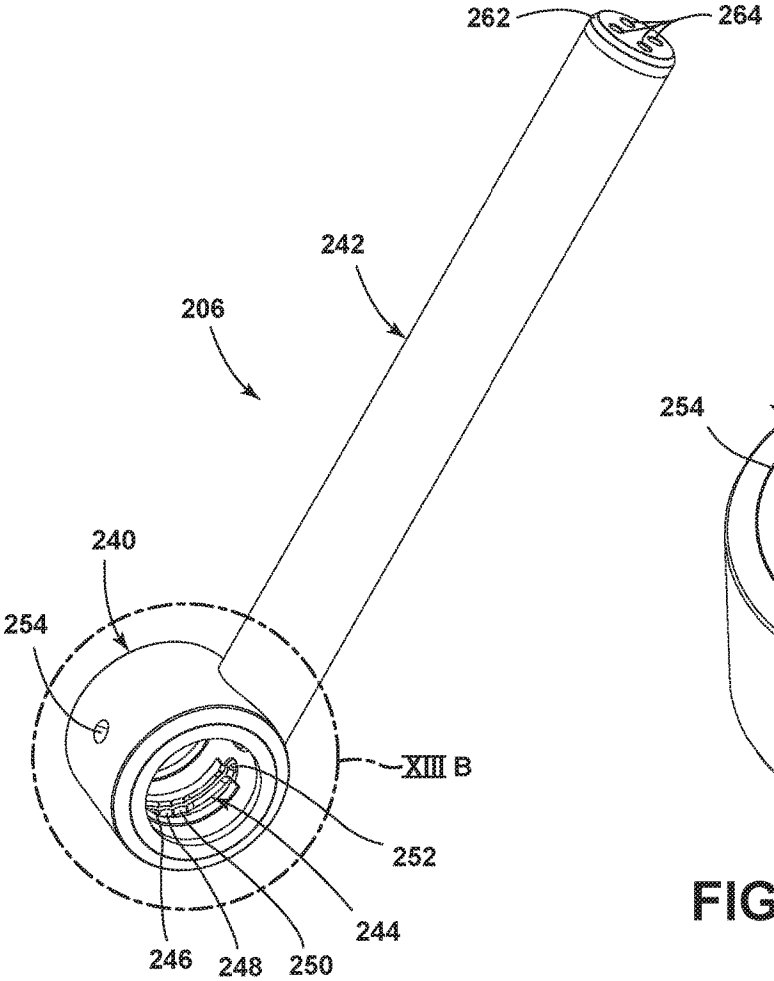
FIG. 13A is an enlarged perspective view of a sprayer from the rack spray assembly of FIG. 11.
Figure 14B:
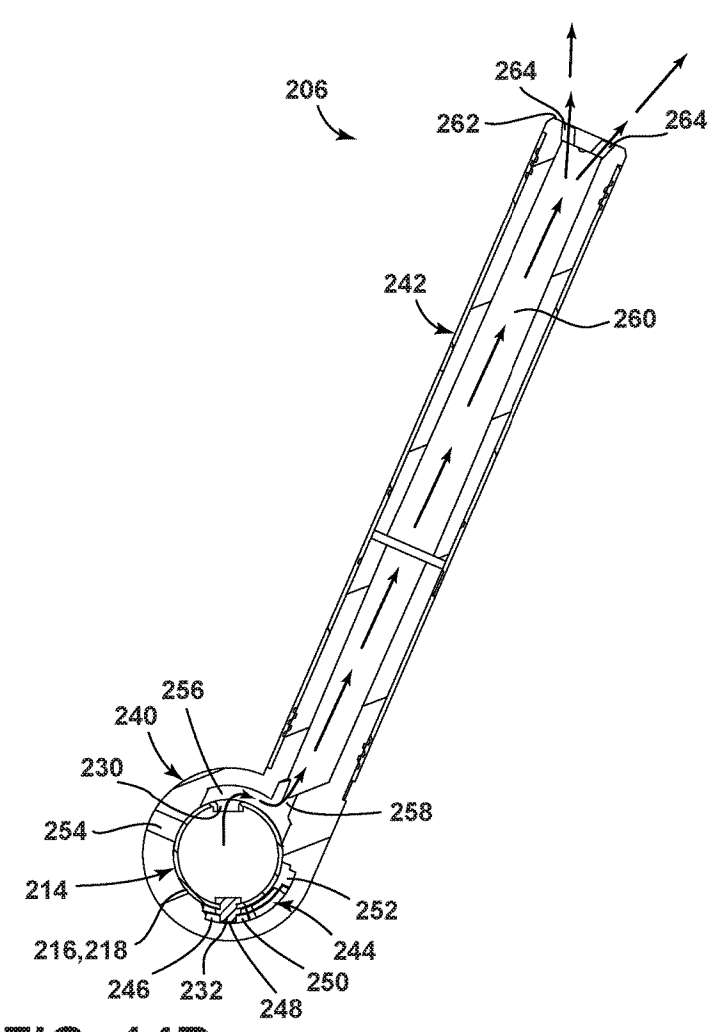
FIGS. 14A-14D are sectional views of the sprayer of FIG. 11 in three raised positions and a lowered position, respectively.
Figure 14A:
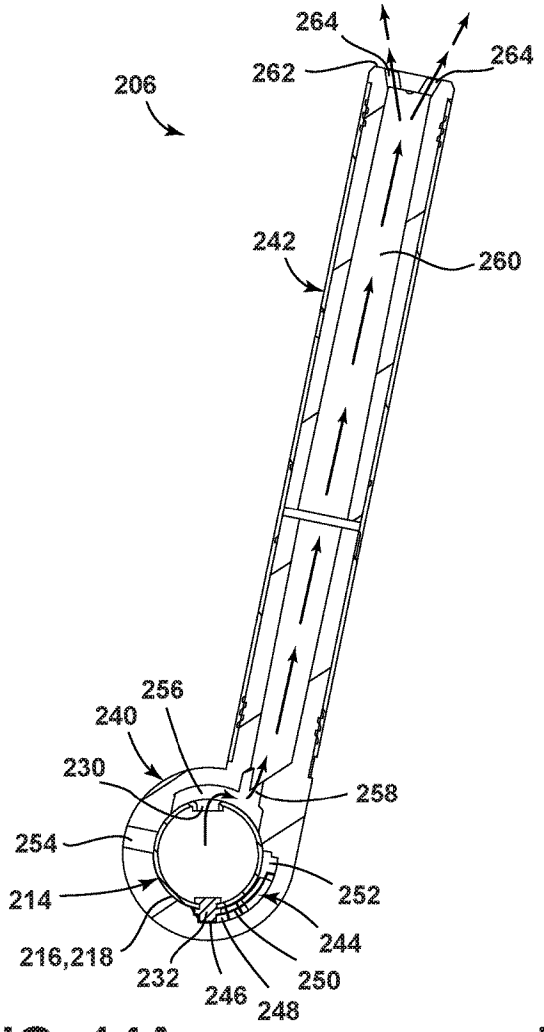
Figure 14C:
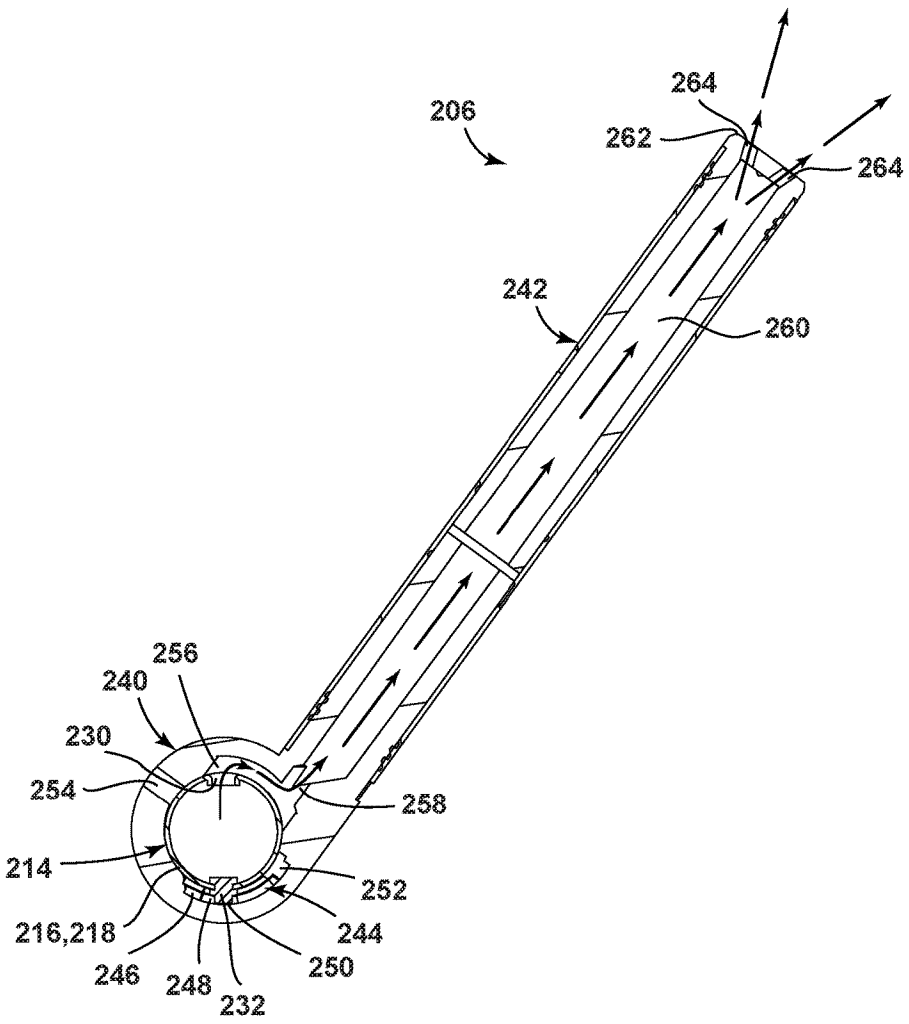

Referring now to FIG. 13A, the sprayer 206 includes a body 240 and an extension 242 projecting from the body 240. The body 240 may be generally tubular with open ends for receipt of the supply conduit 214. A guide slot 244 formed on an inner surface of the body 240 may include a plurality of detents corresponding to a number of desired positions for the sprayer 206, which is four in the present illustrative embodiment. Three detents 246, 248, 250 correspond to three raised positions and may be spaced from a fourth detent 252 corresponding to a lowered position. Opposite the fourth detent 252 may be a liquid outlet or opening 254 that extends through the body, and opposite the other detents 246, 248, 250 may be, as best seen in FIG. 13B, a recess 256 formed on the inner surface of the body 240 and within which may be located an inlet 258 to the extension 242. Moving on to FIG. 14A, the inlet 258 leads to a liquid channel 260 within the elongated tubular extension 242. The extension 242, which projects linearly from the body 240 with its longitudinal axis laterally offset from the parallel radius of the body 240, terminates at a tip 262 with one or more liquid outlets or openings 264 formed therein and fluidly connected to the liquid channel 260. The present embodiment includes four of the liquid openings 264; however, the extension 242 may include any suitable number, size, and arrangement of liquid openings, which need not be positioned on the tip 262 but may alternatively be located adjacent the tip 262 or along the length of the extension 242 near the tip 262. Spray nozzles may form may the liquid openings 254, 264 for dispensing of the liquid in a spray.

As mentioned above, the sprayer 206 is rotatable between a plurality of raised positions and a lowered position, which are illustrated in the sectional views of the sprayer 206 and the supply conduit 214 in FIGS. 14A-14D. The three exemplary raised positions shown in FIGS. 14A-14C, hereinafter referred to as the first, second, and third raised positions for convenience, situate the extension 242 at an acute angle with respect to a horizontal reference, which may be the bottom wall 70 of the dish rack 200 (FIG. 15), wherein the acute angle decreases moving from the first raised position to the second raised position to the third raised position. In the highest position of the extension 242, i.e., the first raised position, shown in FIG. 14A, the extension 242 is slightly inclined from a vertical position; however, it is well within the scope of embodiments of the invention for the extension 242 to be positioned generally vertical in the raised position. In the first, second, and third raised positions of FIGS. 14A-14C, the guide pin 232 resides in one of the respective detents 246, 248, 250 based on the rotational position of the sprayer body 240, and the guide pin 232 secures the sprayer 206 in each position until sufficient force is applied to move the guide pin 232 out the detent 246, 248, 250 within which it is seated and along the guide slot 244. Further, in all of the raised positions, the recess 256 of the sprayer body 240 is aligned with the liquid opening 230 on the supply conduit 214, thus placing the liquid opening 230 in fluid communication with the inlet 258, the liquid channel 260, and the liquid openings 264 at the extension tip 262 to spray liquid supplied by the supply conduit 214 through the extension 242. The liquid opening 254 on the body 240 does not fluidly communicate with the supply conduit liquid opening 230, thus resulting in no liquid flow through the liquid opening 254.

Figure 14D:
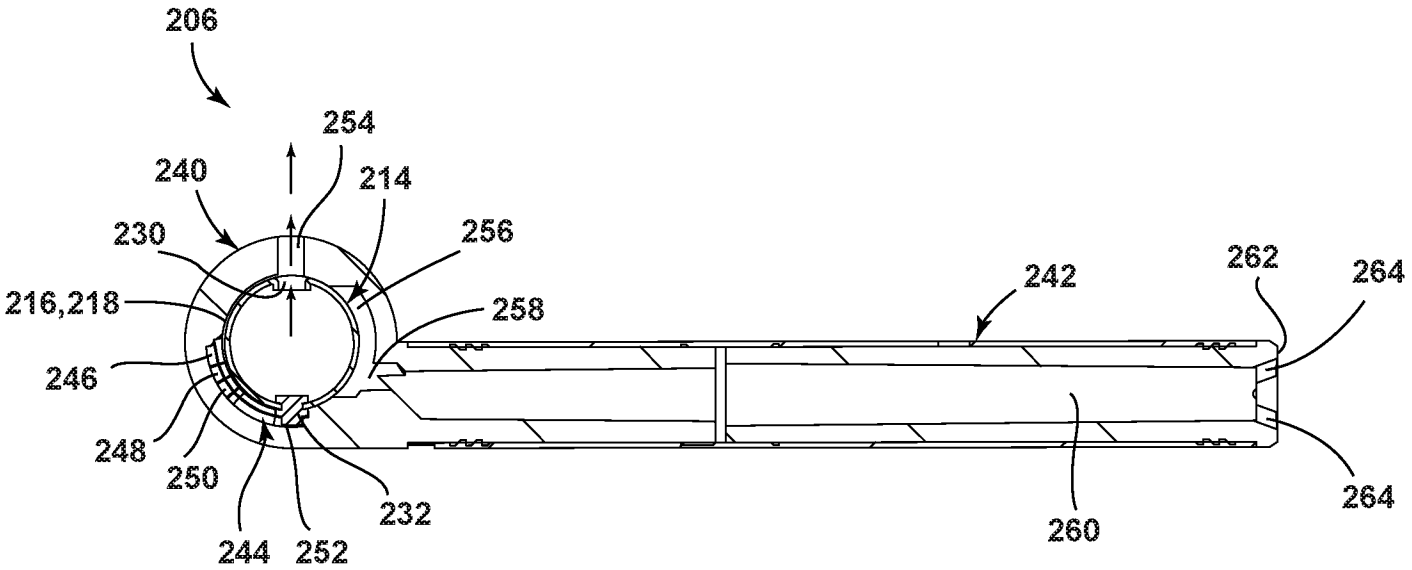

When the sprayer 206 is in the lowered position of FIG. 14D, which may be generally horizontal, the body 240 is situated so that the guide pin 232 resides in the detent 252, and the liquid opening 254 aligns with the supply conduit liquid opening 230 to spray liquid supplied by the supply conduit 214 through the body 240. The recess 256 on the body does not fluidly communicate with the supply conduit liquid opening 230, which results in no liquid flow into the extension 242.

Figure 15:
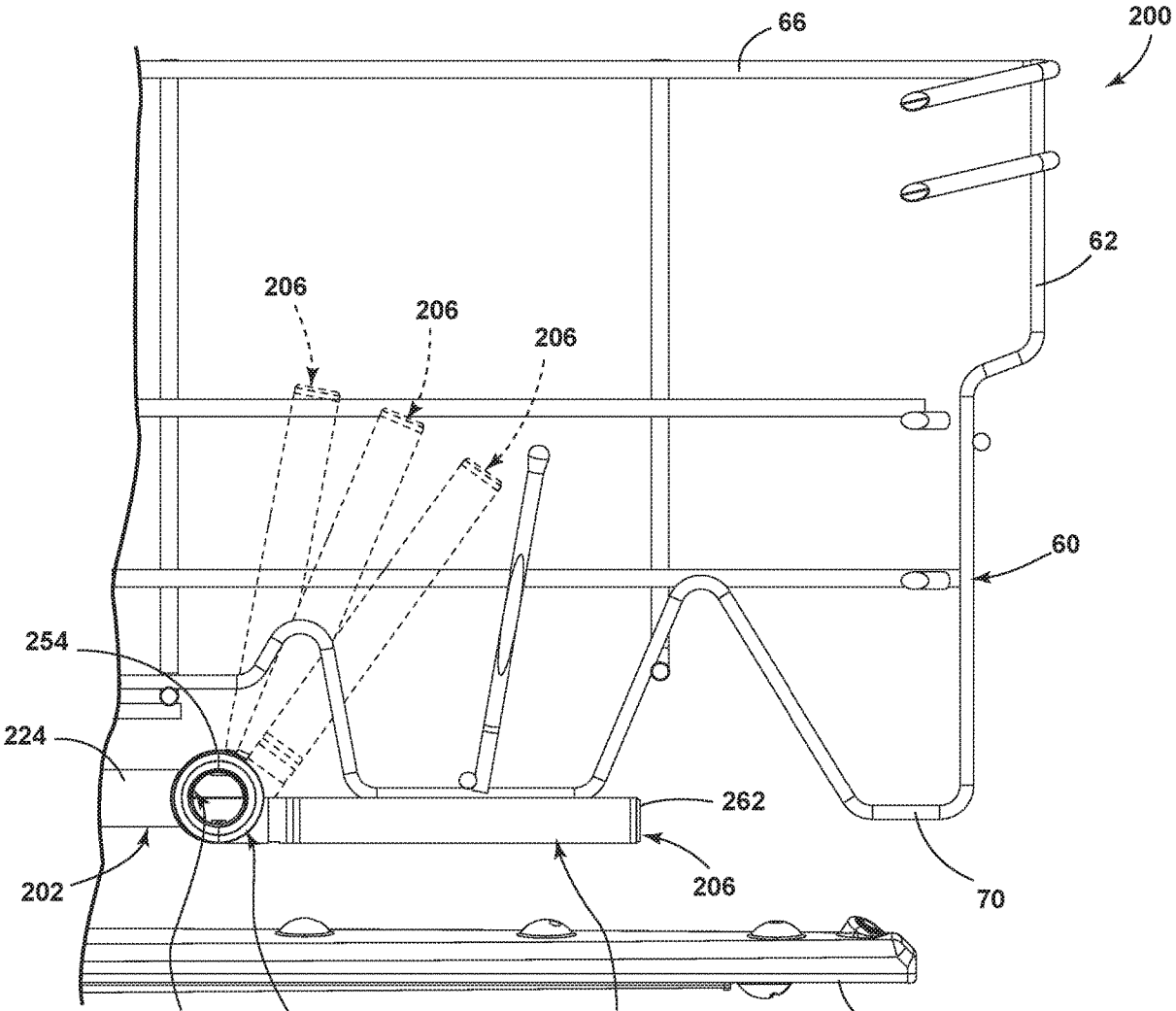
FIG. 15 is a partial view of the dish rack and rack spray assembly of FIG. 11 showing the sprayer in the four positions from FIGS. 14A-14D.

FIG. 15 illustrates the spatial relationship between the dish rack 200 and the sprayer 206 in the raised and lowered positions. When the sprayer 206 is in any of the raised positions, shown in phantom in FIG. 15, the extension 242 extends into the dish rack 200 for spraying items held in the dish rack 200, such as items placed directly onto the extension 242. In contrast, when the sprayer 206 is in the lowered position, the extension 242 is below the bottom wall 70 of the dish rack 200 and generally parallel to the bottom wall 70 so as to avoid interfering with dishes held in the dish rack 200, while the body 240 is positioned so that the liquid outlet 254 generally faces upward for dispensing liquid into the dish rack 200. The sprayer 206 emits liquid into the dish rack 200 from a higher location when in the raised positions compared to the lowered position.

The illustrated positions of the sprayer 206 are provided for exemplary purposes, and it is contemplated that that sprayer 206 can have any suitable angle relative to the horizontal when in any raised or lowered positions. Further, the sprayer 206 may have only one raised position or any number of raised positions. The sprayer 206 may also have multiple lowered positions; for example, the user may desire to orient the liquid opening 254 to spray into the dish rack 200 at varying angles in addition to or as an alternative to spraying vertically upward, which may be achieved by positioning the sprayer 206 in differing lowered positions.

The operation of the rack spray assembly 202 shown in FIGS. 11-15 is essentially the same as that for the rack spray assembly 34 in the previous embodiments and will not be repeated here for brevity. Further, the modifications described above for the rack spray assembly 34 apply to the rack spray assembly 202, including those related to the operation thereof.

Figure 16:
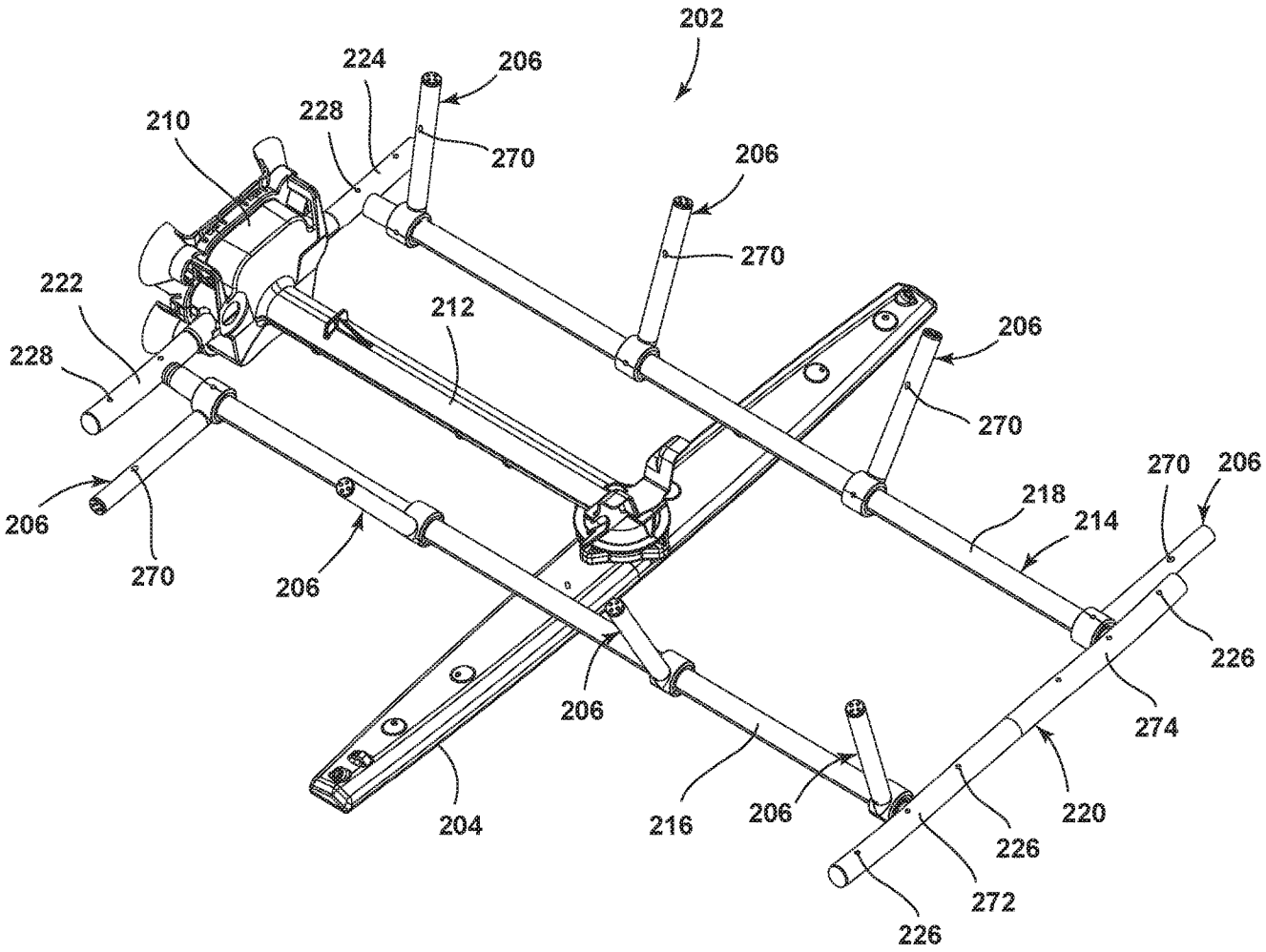
FIG. 16 is a perspective view of an alternative rack spray assembly according to another embodiment.
Figure 17:
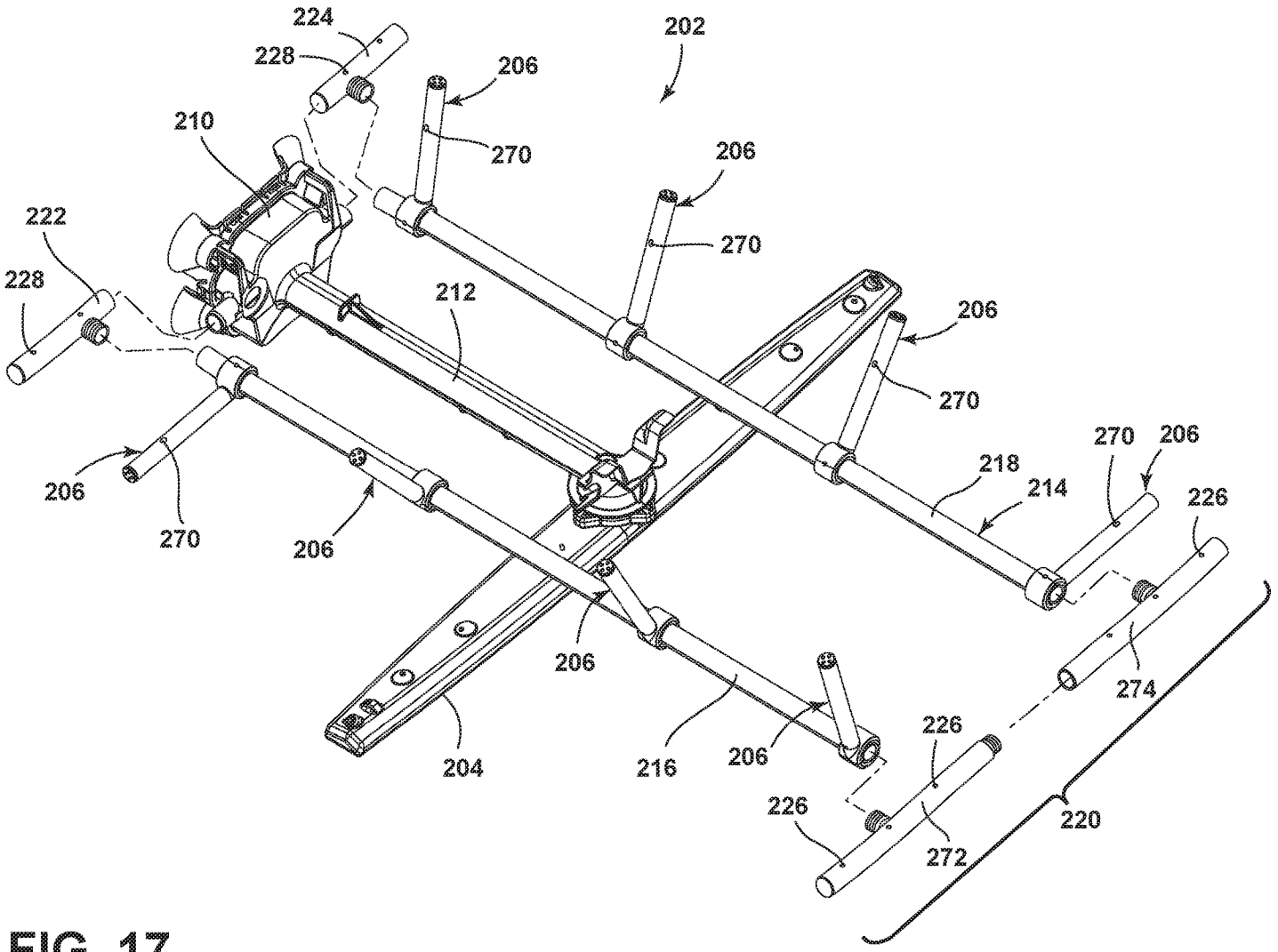
FIG. 17 is a partially exploded view of the rack spray assembly of FIG. 16.

FIGS. 16 and 17 provide perspective and exploded views, respectively, of another embodiment of a rack spray assembly substantially similar to the embodiment of FIGS. 11-15 with modified front and rear connecting conduits 220, 222, 224 and a modified sprayer 206. The front connecting conduit 220 of the present embodiment may be formed by a manifold that connects to the front ends of the spaced conduits 216, 218. The manifold may include a pair of connected tubes 272, 274 that may be joined together and then mounted to the spaced conduits 216, 218. The manifold may have several of the liquid outlets or openings 226, as in the previous embodiment. Similarly, the rear connecting conduits 222, 224 of the present embodiment may be formed by a manifold that connects to the rear ends of the spaced conduits 216, 218. Each side of the manifold may be a tube with liquid outlets or openings 228, as in the previous embodiment. The manifold design allows extension of the width of the connecting conduits 220, 222, 224 beyond the width of the spaced conduits 216, 218, if desired and as illustrated. Optionally, the manifolds may extend to the side walls of the rack so as to provide additional spraying along the entire width of the dish rack.

The sprayer 206 of the present embodiment is similar to the sprayer 206 in the embodiment of FIGS. 11-15 but is modified to include an additional liquid opening 270 along the length of the extension 242, specifically on the side of the extension 242 that faces upward when in the lowered position. The sprayer 206 may be configured to spray liquid from the additional liquid opening 270 in the raised position and/or in the lowered position. The additional liquid opening 270 may be positioned on the extension 242 to face upwardly when the extension 242 is in the lowered position so that the spray from the liquid opening is directed into the dish rack.

Figure 18A:
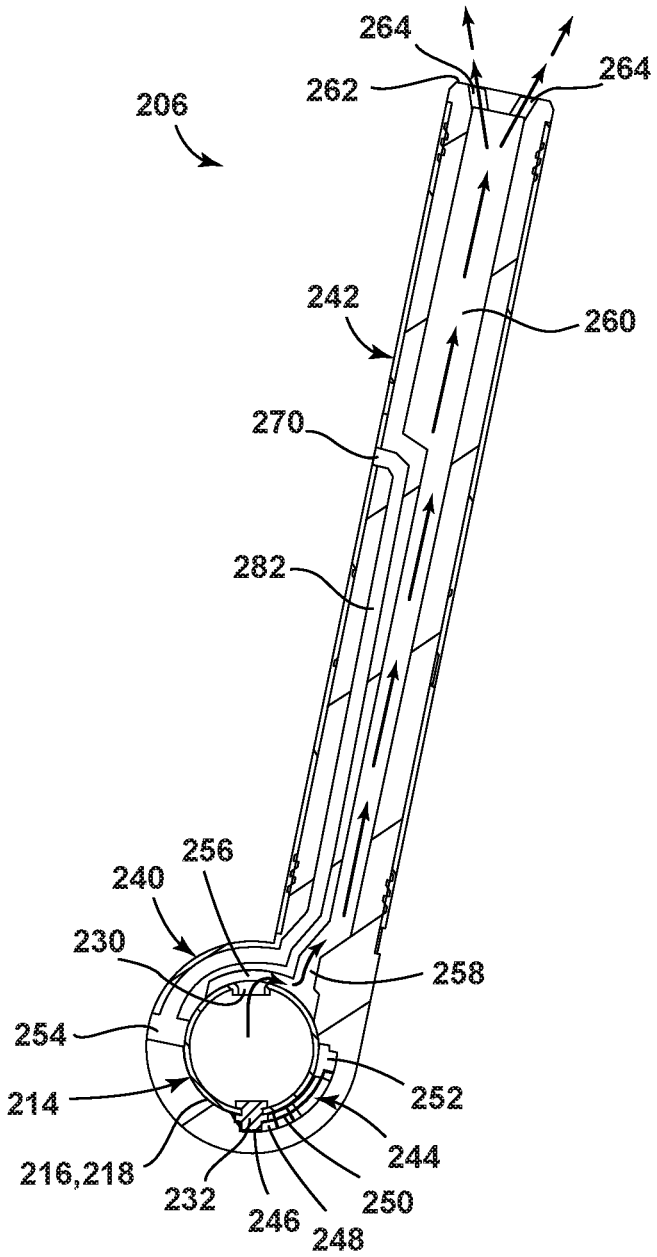
FIGS. 18A and 18B are sectional views of a sprayer from the rack spray assembly of FIG. 16 shown in the same raised and lowered positions respectively illustrated in FIGS. 14A and 14D.
Figure 18B:
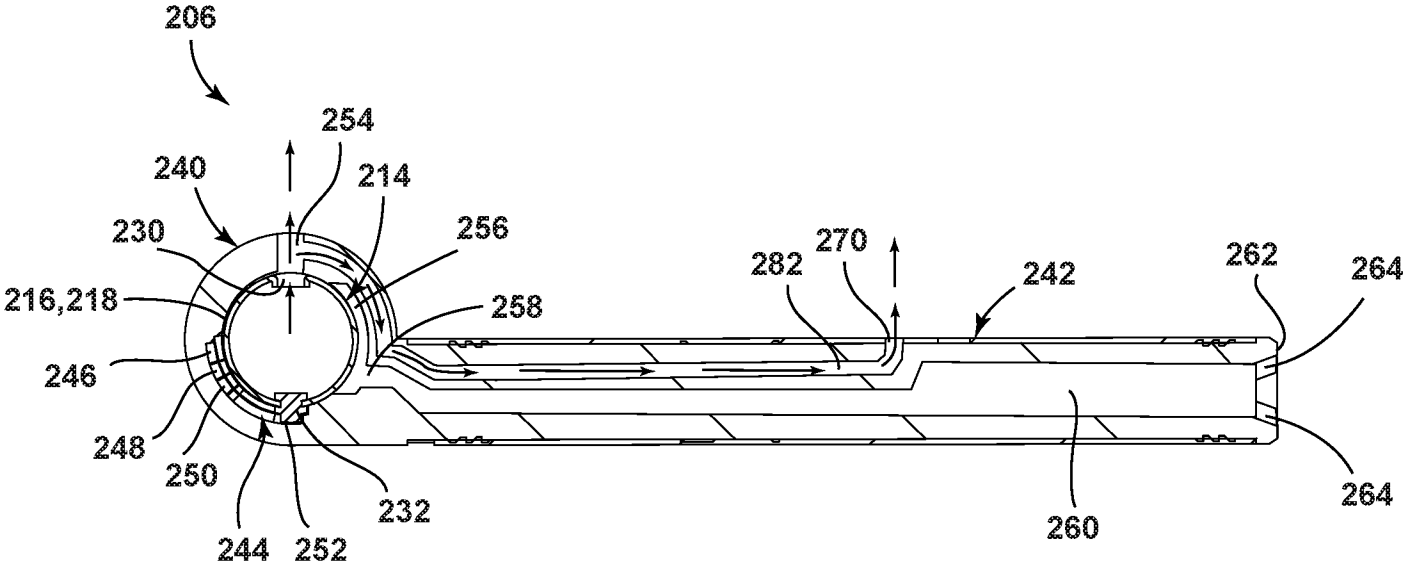

As an example, FIGS. 18A and 18B present sectional views of the modified sprayer 206 with the additional liquid opening 270 wherein the sprayer 206 is configured to supply liquid through the additional liquid opening 270 only in the lowered position. Referring to FIG. 18A, which shows the sprayer 206 in the same raised position shown in FIG. 14A, i.e., the first raised position, the sprayer 206 includes two liquid channels: (1) the liquid channel 260 that provides liquid to the liquid openings 264 at the tip 262 of the extension 242 and (2) an additional liquid channel 282 that fluidly couples the liquid opening 254 with the additional liquid opening 270. When the sprayer 206 is in the first raised position, and also in the second and third raised positions, the supply conduit liquid opening 230 aligns with the recess 256 to allow liquid to flow from the supply conduit 214, through the liquid opening 230, through the recess 256, into the inlet 258, through the liquid channel 260, and out the liquid openings 264 to emit spray from the tip 262 of the extension 242. The liquid openings 254, 270 do not fluidly communicate with the supply conduit 214.

Referring now to FIG. 18B, when the sprayer 206 is in the lowered position, the supply conduit liquid opening 230 aligns with the liquid opening 254 to allow liquid to flow from the supply conduit 214, through the liquid opening 230, and out the liquid opening 254 to emit spray upward from the body 240 of the sprayer 206. In addition, liquid flows from the liquid opening 254 into the liquid channel 282 and out the liquid opening 270 to emit spray upward from the side of the extension 242. The liquid openings 264 do not fluidly communicate with the supply conduit 214.

The additional liquid channel 282 may have any suitable configuration. In one alternative design, the liquid channel 282 need not be fluidly connected to the liquid opening 254, so as to not interfere with spray emission from the liquid opening 254, but rather be fluidly connected to the supply conduit liquid opening 230 in another manner, or perhaps to another liquid opening in the supply conduit 214. In another alternative embodiment, the liquid opening 270 may be fluidly coupled with the liquid channel 260 such that liquid sprays from the liquid opening 270 at the same time that liquid sprays from the liquid openings 264, i.e., in the raised position(s). As another option, the liquid opening 270 may be fluidly coupled to both the liquid channel 260 and the liquid channel 282 for providing spray from the liquid opening 270 in both the raised and lowered positions.

Figure 19A:
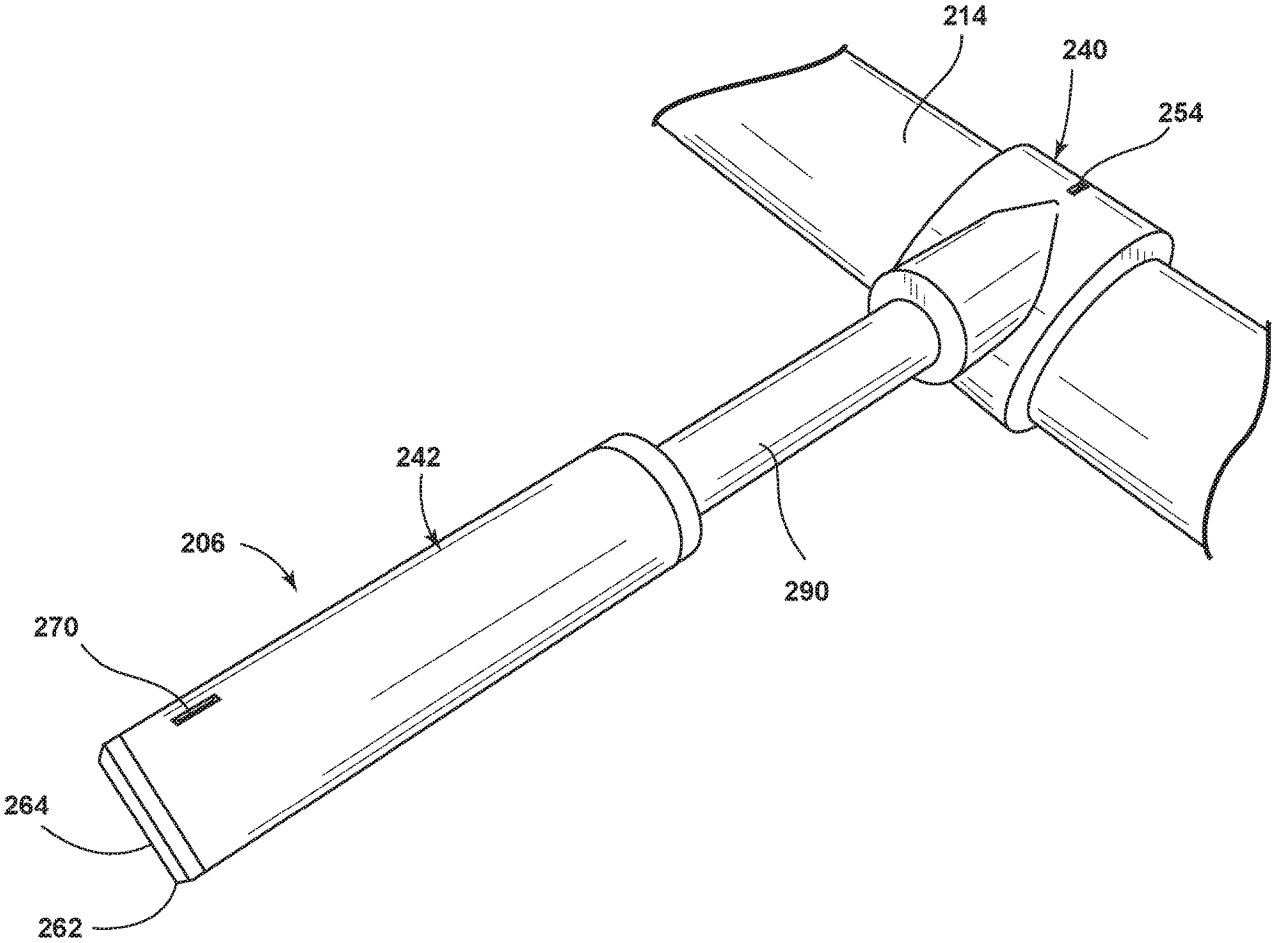
FIGS. 19A-19C are perspective views of an alternative sprayer according to another embodiment in fully extended, fully retracted, and partially extended positions, respectively.
Figure 19B:
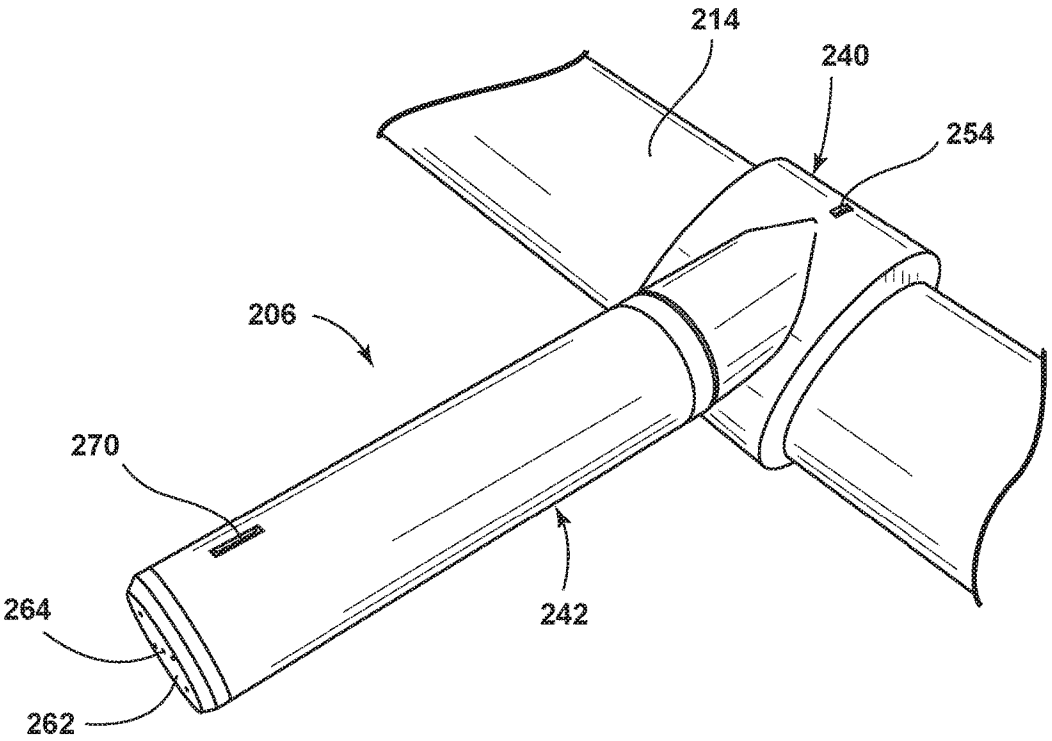
Figure 19C:
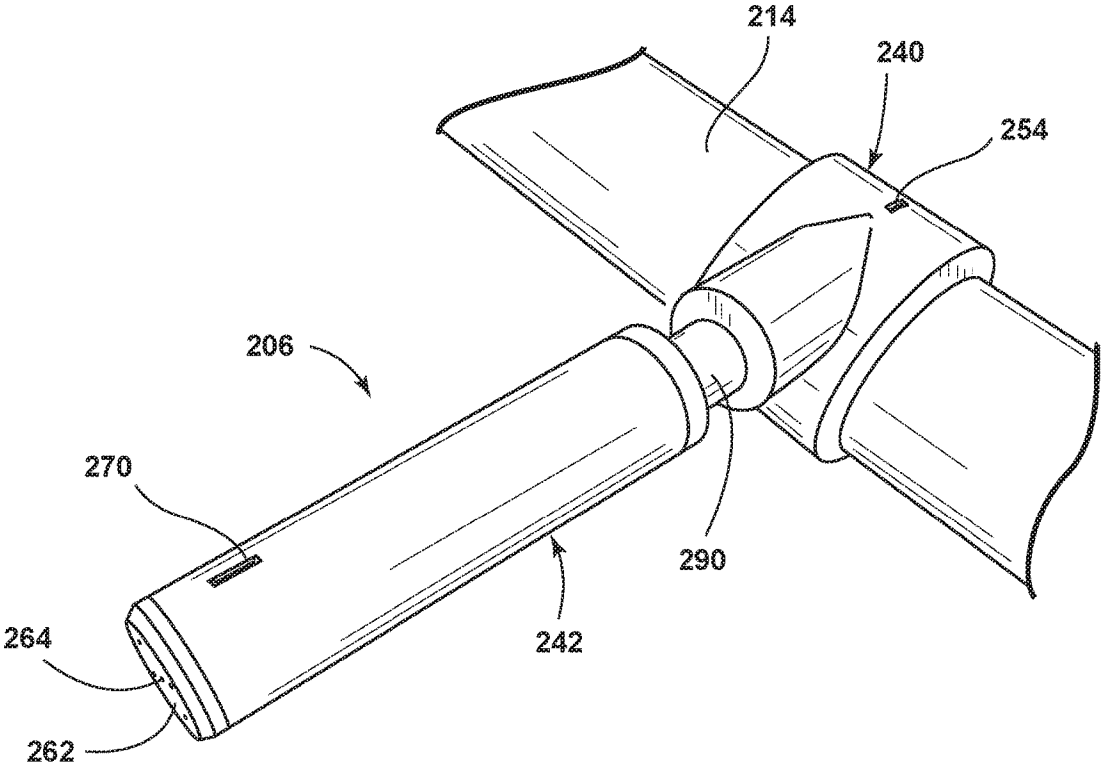

Another exemplary alternative embodiment sprayer 206 is illustrated in the perspective views of FIGS. 19A-19C. The sprayer 206 may be similar to the sprayers 206 in FIGS. 11-18B but may be configured for telescoping movement about its longitudinal axis in addition to rotational movement about the supply conduit 214. As seen in FIG. 19A, the sprayer 206 may include the body 240, which is rotatable about the supply conduit 214, the extension 242, and a shaft 290 coupling the extension 242 to the body 240. The shaft 290 may be fixedly mounted to the body 240, and the extension 242 may be slidably mounted to the shaft 290 such that the extension 242 may slide relative to the body 240 and the shaft 290 between an extended position, shown in FIG. 19A, and a retracted position, shown in FIG. 19B, to effectively change the length of the sprayer 206 and, thus, the distance to which the sprayer 206 extends into the dish rack 20 when the sprayer 206 is raised.

The sprayer 206 may extend and retract in any suitable manner. In one example, the user may manually move the sprayer 206 between the extended and retracted positions by grasping the extension 242 and sliding the extension 242 along the shaft 290 in the desired direction. The sprayer 206 may include a lock or other structure to secure the extension 242 in the extended position. In another example, the sprayer 206 may extend and retract in response to liquid flow, or lack thereof, in the sprayer 206. When liquid flows into the sprayer 206, the pressure of the liquid may force the extension 242 to slide from the retracted position to the extended position. The extension 242 may remain in the extended position while the liquid continues to flow through the sprayer 206 and may retract when the liquid flow decreases and/or ceases. Optionally, the sprayer 206 may be configured so that the degree to which the extension 242 extends depends on the liquid pressure, during both extension and retraction. In such an embodiment, the extension 242 may assume an intermediate, partially extended position between fully extended and fully retracted, as illustrated by example in FIG. 19C, when the liquid pressure is intermediate the pressures that result in the full extension and full retraction. The liquid pressure may be optionally tailored according to a height of a dish placed on the extension 242 whereby the liquid pressure is set so that the amount of extension corresponds to the height of the glass (i.e., less extension for a shorter glass, more extension for a taller glass). In yet another example, the extension 242 may be operably coupled to a motor or other type of actuator that may automatically move the extension 242 into the desired extended or retracted position and, optionally, also rotate the sprayer 206 to the desired raised or lowered position.

The operation of the sprayer 206 may be substantially similar to the operation described previously for the sprayers 206 in earlier embodiments. The primary difference in operation is related to the extension and retraction of the extension 242. When the sprayer 206 is in a raised position, the extension 242 may be in the fully or partially extended position, either by manual or automatic methods, for spraying the liquid onto dishes in the rack 20. Upon movement to the lowered position, while it is acceptable for the sprayer 206 to remain extended, the sprayer 206 may assume the retracted position.

The telescoping and rotating sprayer 206 of FIGS. 19A-19C may differ from the specific structure shown in the illustrations. For example, the sprayer 206 may or may not include the additional liquid opening 270. Additionally, the sprayer 206 may be configured for telescoping movement in another manner and is not limited to the particular shaft 290 upon which the extension 242 slides.

Figure 20:
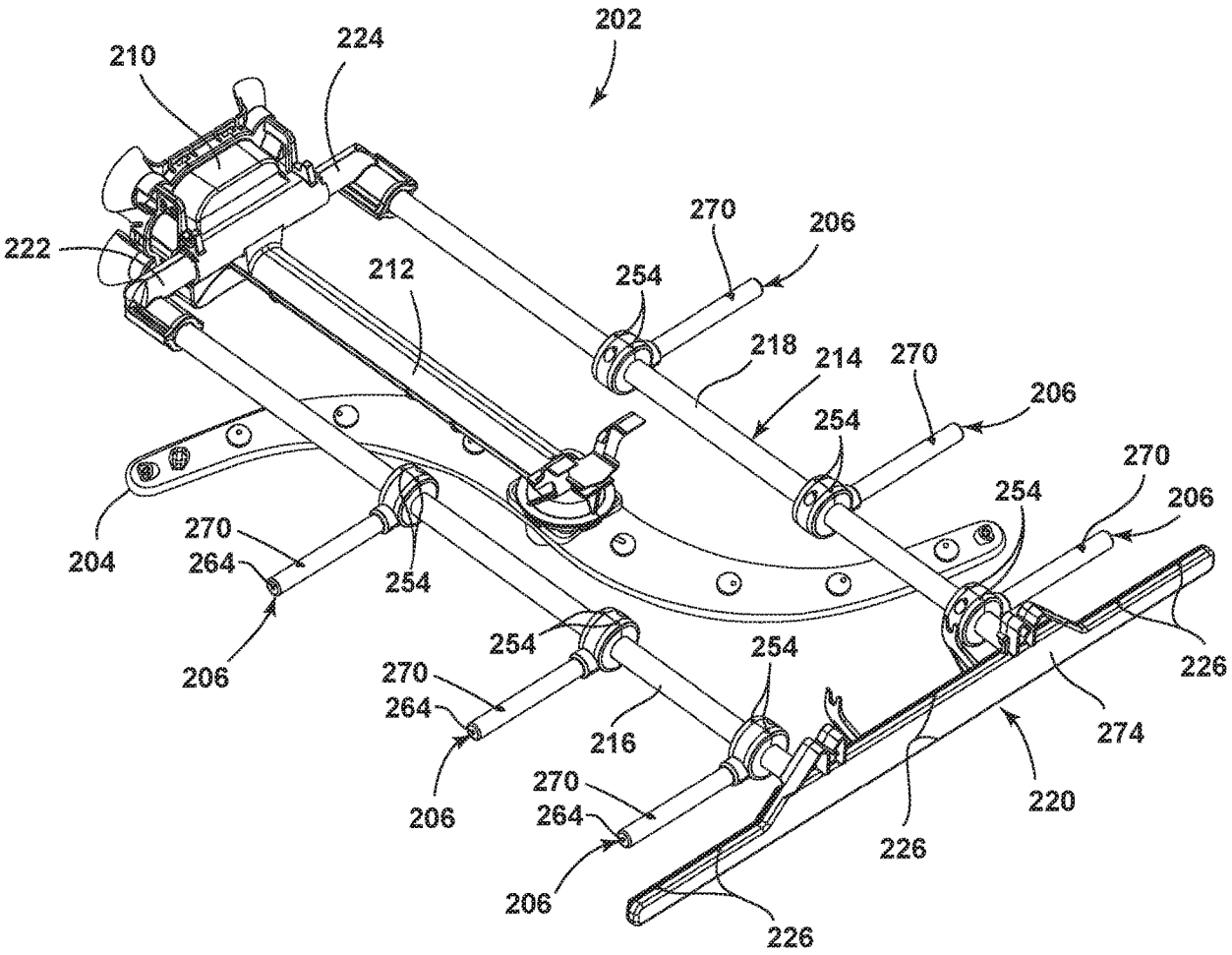
FIG. 20 is a perspective view of an alternative rack spray assembly according to another embodiment.

Yet another exemplary alternative embodiment of the rack spray assembly 202 is illustrated in the perspective view of FIG. 20. The rack spray assembly 202 is similar to the previous embodiments and includes a modified spray arm 204, modified front and rear connecting conduits 220, 222, 224 and a modified sprayer 206.

The spray arm 204 of the present embodiment is in an s-shaped arm. The front connecting conduit 220 of the present embodiment may be formed by a manifold that connects to the front ends of the spaced conduits 216, 218. The manifold may include a single tube 272 that may be mounted to the spaced conduits 216, 218. The front connecting conduit has been illustrated as extending beyond the width of the spaced conduits 216, 218 although this need not be the case. The manifold may have several liquid outlets or openings 226, as in the previous embodiment. The openings 226 may spray upwards and/or downwards. In the illustrated example, there are a plurality of openings 226 along the top of the manifold and a single opening on the bottom of the manifold. It will be understood however that any number of openings, which may spray in any direction, may be included in the front connecting conduit 220.

Similarly, the rear connecting conduits 222, 224 of the present embodiment may be formed by a manifold that connects to the rear ends of the spaced conduits 216, 218. While no openings or liquid outlets have been illustrated, it is contemplated that each side of the manifold may be a tube with liquid outlets, as in the previous embodiment. In the present embodiment the connecting conduits 222, 224 do not extend beyond the width of the spaced conduits 216, 218, although they may if desired.

Figure 21A:
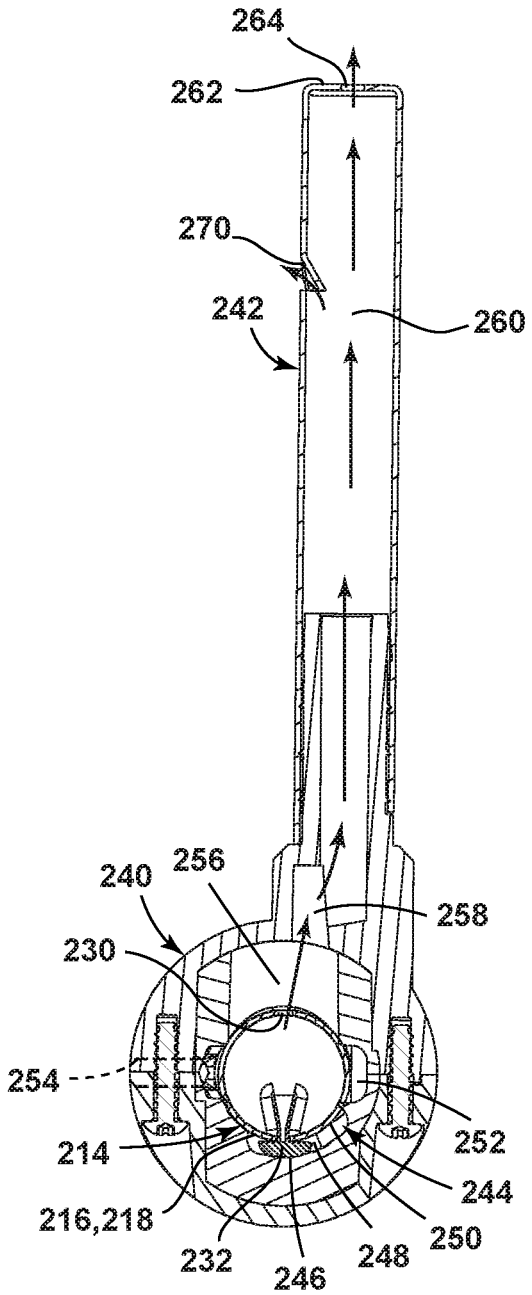
FIGS. 21A and 21B are sectional views of a sprayer from the rack spray assembly of FIG. 20 shown in the same raised and lowered positions respectively illustrated in FIGS. 14A and 14D.
Figure 21B:
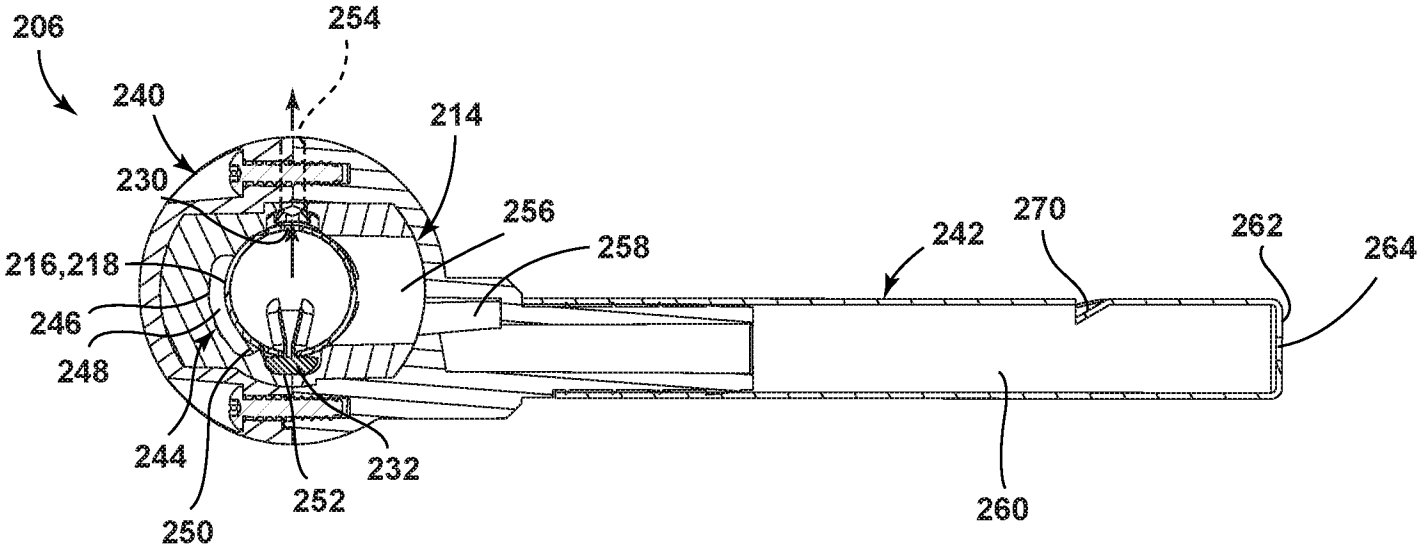

The sprayer 206 of the present embodiment is similar to the sprayer 206 in the embodiment of FIGS. 16-18B but is limited to the sprayer 206 being configured to spray liquid from the additional liquid opening 270 in the raised position. As an example, FIGS. 21A and 21B illustrate sectional views of the modified sprayer 206 with the additional liquid opening 270 wherein the sprayer 206 is configured to supply liquid through the additional liquid opening 270 only in the raised position. Referring to FIG. 21A, which shows the sprayer 206 in the same raised position shown in FIG. 14A, i.e., the first raised position, the sprayer 206 includes a single liquid channel 260 that provides liquid to both the liquid opening(s) 264 at the tip 262 of the extension 242 and the additional liquid opening 270. When the sprayer 206 is in the first raised position, and also in the second and third raised positions, the supply conduit liquid opening 230 aligns with the recess 256 to allow liquid to flow from the supply conduit 214, through the liquid opening 230, through the recess 256, into the inlet 258, through the liquid channel 260, and out the additional liquid opening 270 and out the liquid opening(s) 264 to emit spray from the tip 262 of the extension 242. The liquid opening 254 does not fluidly communicate with the supply conduit 214.

Referring now to FIG. 21B, when the sprayer 206 is in the lowered position, the supply conduit liquid opening 230 aligns with the liquid opening 254 to allow liquid to flow from the supply conduit 214, through the liquid opening 230, and out the liquid opening 254 to emit spray upward from the body 240 of the sprayer 206. The liquid opening(s) 264 and the additional liquid opening 260 do not fluidly communicate with the supply conduit 214.

Figure 22:
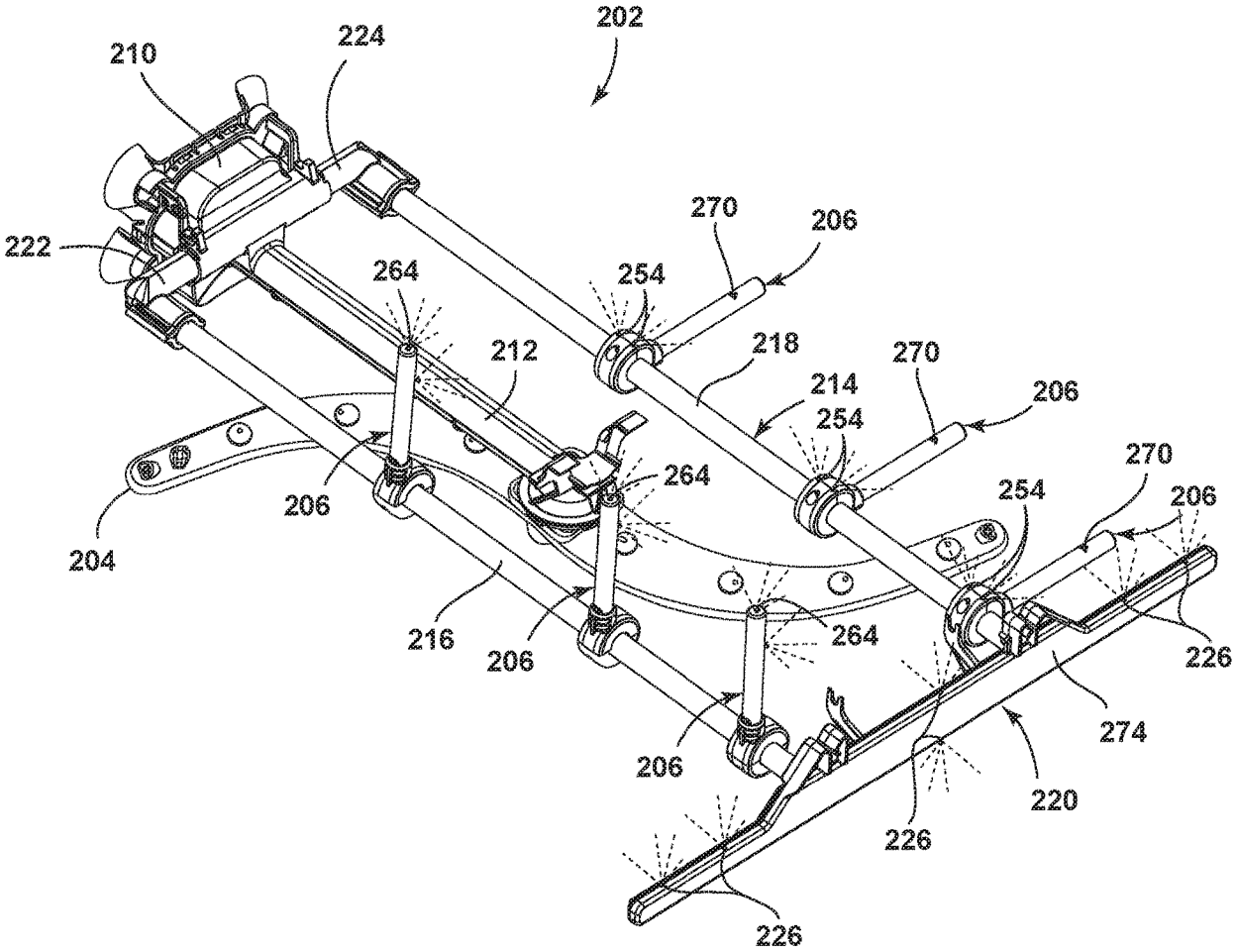
FIG. 22 is a perspective view of the rack spray assembly of FIG. 20 illustrating sprays from the rack spray assembly during operation.

FIG. 22 illustrates several of the sprayers 206 in the lowered position and several of the sprayers 206 in the raised position. As can be seen, when the sprayer 206 is in the lowered position spray is emitted only from the liquid openings 254 and when the sprayer 206 is in the raised position spray is not emitted from the liquid opening 254 but is emitted from both the additional liquid openings 270 and the liquid opening(s) 264. Further, FIG. 22 shows sprays emitted from both an upper and lower portion of the front connecting conduit 220 through the openings 226. While sprays have not been shown as being emitted from the spray arm 204 for clarity purposes, it will be understood that sprays may also be emitted from the spray arm 204 at the same time as form the remainder of the rack spray assembly 202.

Alternatively, the rack spray assemblies 202 in FIGS. 11-22 need not include the front connecting conduit 220 such that the spaced conduits 216, 218 terminate at their front ends. Additionally, the sprayers 206 may be modified as desired, and any suitable sprayers 206 may be used with the supply conduit 214. Optionally, the extension 242 may be removable from the body 240 for maintenance or replacement. Further, the supply conduit 214 and the sprayers 206 may be configured so that the sprayers 206 may rotate relative to the supply conduit 214 without being obstructed by the wires of the dish rack, or the dish rack may be modified to accommodate the movement of the sprayers 206.

While the sprayers 84, 206 may be configured to provide liquid to any size and shape of dishes, including glassware, exemplary ranges of dimensions for glassware that may be especially suitable for positioning on the sprayers 84, 206 when in the raised position for treatment thereof are: height—165 mm (6.5 inches) to 241 mm (9.5 inches), body diameter—64 mm (2.5 inches) to 89 mm (3.5 inches), and neck diameter—138 mm (1.5 inches) to 64 mm (2.5 inches).

To the extent not already described, the different features and structures of the various embodiments may be used in combination with each other as desired. That one feature may not be illustrated in all of the embodiments and is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation, and the scope of the appended claims should be construed as broadly as the prior art will permit.

What is claimed is:

1. A spray assembly, comprising:

a first liquid supply conduit having a length configured to be located adjacent a dish rack within a treating chamber of a dishwasher and configured to be fluidly coupled to a recirculation system of the dishwasher, a second liquid supply conduit configured to be fluidly coupled to the recirculation system of the dishwasher;

at least one sprayer located on the length of the first liquid supply conduit and selectively fluidly coupled to the first liquid supply conduit, the at least one sprayer having a first liquid opening and an extension having a second liquid opening wherein the extension is movable between a first position where treating liquid flows from the first liquid supply conduit through the first liquid opening into the treating chamber and does not flow through the second liquid opening and a second position, which is raised from the first position, where the treating liquid flows from the first liquid supply conduit through the second liquid opening into the treating chamber; and a rotatable sprayer mounted to an end of the second liquid supply conduit and configured to emit sprays into the treating chamber.

2. The spray assembly of claim 1 wherein the at least one sprayer includes a third liquid opening, and when the extension is in the second position, the extension fluidly communicates the third liquid opening with the second liquid opening for flow of the treating liquid from the third liquid opening to the second liquid opening into the treating chamber.

3. The spray assembly of claim 2 wherein when the extension is in the second position, the extension blocks the first liquid opening such that the treating liquid cannot flow through the first liquid opening into the treating chamber.

4. The spray assembly of claim 3 wherein when the extension is in the first position, the extension blocks the third liquid opening such that the treating liquid cannot flow through the third liquid opening into the treating chamber.

5. The spray assembly of claim 4 wherein the at least one sprayer further comprises a seal system mounted to and movable with the extension sealing the first liquid opening when it is blocked by the extension in the second position and sealing the third liquid opening when it is blocked by the extension in the first position.

6. The spray assembly of claim 1 wherein when the extension is in the second position, the treating liquid flows through the first liquid opening to the second liquid opening.

7. The spray assembly of claim 6 wherein the at least one sprayer includes a third liquid opening, and when the extension is in the second position, the extension fluidly communicates the third liquid opening with the second liquid opening for flow of the treating liquid from the third liquid opening, in addition to the flow from the first liquid opening, to the second liquid opening into the treating chamber.

8. The spray assembly of claim 1 wherein the extension is rotated to the second position such that the second liquid opening is located higher than the first liquid opening when the extension is in the second position.

9. The spray assembly of claim 8 wherein the extension comprises an elongated tubular portion and the second liquid opening is located at an end of the elongated tubular portion.

10. The spray assembly of claim 9 wherein the first liquid opening is formed in a portion of the first liquid supply conduit and the elongated tubular portion is rotatable about a longitudinal axis of the first liquid supply conduit.

11. The spray assembly of claim 9 wherein the elongated tubular portion is generally vertical when in the second position.

12. The spray assembly of claim 9 wherein the elongated tubular portion forms a handle graspable by a user for moving the extension between the first and second positions.

13. The spray assembly of claim 8 wherein the extension is movable between multiple second positions wherein the second liquid opening is located higher than the first liquid opening when the extension is in any of the multiple second positions.

14. The spray assembly of claim 1 wherein the first liquid opening is formed in a portion of the first liquid supply conduit.

15. The spray assembly of claim 1 wherein the at least one sprayer comprises a spray nozzle having an opening that defines the first liquid opening.

16. The spray assembly of claim 15 wherein the spray nozzle is recessed on the first liquid supply conduit.

17. The spray assembly of claim 1 wherein the extension is movable to a third position where the treating liquid does not flow through the first liquid opening or the second liquid opening, thus preventing flow of the treating liquid from the at least one sprayer into the treating chamber.

18. The spray assembly of claim 17 wherein the at least one sprayer includes a third liquid opening, and when the extension is in the second position, the extension fluidly communicates the third liquid opening with the second liquid opening for flow of the treating liquid from the third liquid opening to the second liquid opening into the treating chamber, and the extension comprises a closure element that covers and blocks flow of the treating liquid through the first liquid opening and the third liquid openings when the extension is in the third position.

19. The spray assembly of claim 1 wherein when the extension is in the second position, the treating liquid can flow through the first liquid opening into the treating chamber and through the second liquid opening into the treating chamber.

20. A spray assembly, comprising:

a liquid supply conduit having a length configured to be located adjacent a dish rack within a treating chamber of a dishwasher; and multiple rotatable sprayers rotatably mounted to the liquid supply conduit, at least two of the multiple rotatable sprayers spaced along the length of the liquid supply conduit and rotatable between at least a first position adjacent a bottom of the dish rack to a second position extending into the dish rack and wherein the multiple rotatable sprayers are fluidly coupled to the liquid supply conduit and emit spray in both the first and second positions.

21. The spray assembly of claim 20 wherein at least some of the multiple rotatable sprayers comprise an elongated extension terminating in a tip.

22. The spray assembly of claim 21 wherein the elongated extension comprises a first outlet at the tip and a second outlet spaced from the first outlet.

23. The spray assembly of claim 22 wherein at least some of the multiple rotatable sprayers further comprise a body mounted to the liquid supply conduit with the elongated extension extending from the body, and the second outlet is in the body.

24. The spray assembly of claim 22 wherein at least some of the multiple rotatable sprayers comprise a first spray nozzle with an opening defining the first outlet and a second spray nozzle with an opening defining the second outlet.

25. The spray assembly of claim 22 wherein the first outlet emits spray only in the second position, and the second outlet emits liquid only in the first position.

26. The spray assembly of claim 20 wherein the spray assembly further comprises non-rotatable sprayers fluidly coupled to the liquid supply conduit.

27. The spray assembly of claim 26 wherein the non-rotatable sprayers comprise outlets in the liquid supply conduit.

28. The spray assembly of claim 27 wherein the liquid supply conduit comprises spaced conduits fluidly coupled by a connecting conduit, and at least one of the non-rotatable sprayers is located on the connecting conduit.

29. The spray assembly of claim 28 wherein the liquid supply conduit has a U-shape with legs defined by the spaced conduits and a bight portion connecting the legs and defined by the connecting conduit.

30. The spray assembly of claim 29 wherein at least some of the multiple rotatable sprayers are rotatably mounted to the spaced conduits.

31. The spray assembly of claim 28 wherein the connecting conduit is formed by a first manifold located at front ends of the spaced conduits.

32. The spray assembly of claim 31 wherein the first manifold is formed by a pair of connected tubes, and each of the connected tubes is mounted to the front end of one of the spaced conduits.

33. The spray assembly of claim 31 wherein a second manifold is located at rear ends of the spaced conduits such that the first manifold and second manifold connect the spaced conduits at both ends of the spaced conduits, respectively.

34. The spray assembly of claim 20 wherein at least one rotatable sprayer of the multiple rotatable sprayers is also telescopic between extended and retracted positions, thus changing a height to which the at least one rotatable sprayer extends in the second position.

35. The spray assembly of claim 20 wherein at least one rotatable sprayer of the multiple rotatable sprayers comprises a body mounted to the liquid supply conduit, a shaft extending from the body, and an elongated extension slidably mounted to the shaft for movement between extended and retracted positions.

36. The spray assembly of claim 35 wherein the elongated extension is movable in response to liquid flow in the at least one rotatable sprayer.

* * * * *